US006675730B2

(12) United States Patent
Simard et al.

(10) Patent No.: US 6,675,730 B2
(45) Date of Patent: Jan. 13, 2004

(54) PERSONAL WATERCRAFT HAVING OFF-POWER STEERING SYSTEM

(75) Inventors: Richard Simard, St-Charles-de-Drummond (CA); Renald Plante, Rock-Forest (CA); Yves Berthlaume, Palm Bay, FL (US); Rick Adamczyk, St. Cloud, FL (US)

(73) Assignee: Bombardier Inc., Valcourt (CA)

( * ) Notice: Subject to any disclaimer, the term of this patent is extended or adjusted under 35 U.S.C. 154(b) by 0 days.

(21) Appl. No.: 10/195,324

(22) Filed: Jul. 16, 2002

(65) Prior Publication Data

US 2003/0019411 A1 Jan. 30, 2003

Related U.S. Application Data

(63) Continuation-in-part of application No. 09/850,173, filed on May 8, 2001, now Pat. No. 6,523,489, which is a continuation-in-part of application No. 09/775,806, filed on Feb. 5, 2001, now abandoned.

(60) Provisional application No. 60/375,401, filed on Apr. 26, 2002, and provisional application No. 60/180,223, filed on Feb. 4, 2000.

(51) Int. Cl.[7] ..... B63B 35/73

(52) U.S. Cl. ..... 114/55.52; 440/38; 440/43

(58) Field of Search ..... 114/55.52; 440/38–43

(56) References Cited

U.S. PATENT DOCUMENTS

| | | | |
|---|---|---|---|
| 3,159,134 | A | 12/1964 | Winnen |
| 3,250,072 | A | 5/1966 | Smith |
| 3,272,171 | A | 9/1966 | Korcak |
| 3,280,786 | A | 10/1966 | Rowell |
| 3,326,168 | A | 6/1967 | Swiggart III, et al. |
| 3,327,671 | A | 6/1967 | Comins |
| 3,435,795 | A | 4/1969 | Eckfield |
| 3,565,030 | A | 2/1971 | Curtis |
| 3,628,486 | A | 12/1971 | Bennett |
| 3,780,683 | A | 12/1973 | Doerffer et al. |
| 3,831,543 | A | 8/1974 | Hamasaki |
| 3,842,787 | A | 10/1974 | Giacosa |
| 3,906,885 | A | 9/1975 | Woodfill |
| 3,942,461 | A | 3/1976 | Smith |
| 3,943,876 | A | 3/1976 | Kiekhaefer |
| 3,948,206 | A | 4/1976 | Tyler |
| 3,949,700 | A | 4/1976 | Baroody |
| 3,976,026 | A | 8/1976 | Eastling |
| 3,982,493 | A | 9/1976 | Cronin |
| 3,982,494 | A | 9/1976 | Posti |
| 4,015,556 | A | 4/1977 | Bordiga |
| 4,046,097 | A | 9/1977 | Hornung |
| 4,073,258 | A | 2/1978 | Logan |

(List continued on next page.)

FOREIGN PATENT DOCUMENTS

| | | |
|---|---|---|
| CA | 2207938 | 7/1998 |
| CA | 2270679 | 12/1999 |
| CA | 2271332 | 2/2000 |
| CA | 2 333 831 | 8/2001 |
| JP | 2000-302099 | 10/2000 |

OTHER PUBLICATIONS

Smith, Steve, *Hot Water*, vol. 5, No. 4, "Them's the Brakes," pp. 8, 51.

*Primary Examiner*—Jesus D. Sotelo
(74) *Attorney, Agent, or Firm*—Pillsbury Winthrop LLP

(57) ABSTRACT

A watercraft is disclosed that includes a hull having port and starboard sides and a propulsion system that generates a stream of pressurized water that exits through a nozzle. A helm operatively connects to the nozzle, whereby turning the helm turns the nozzle. A vane is connected to either or both of the port or starboard sides and is operatively connected to the nozzle. The vane is capable of pivoting inwardly and outwardly in response to steering signals. The vane can also move between an operative position and an inoperative position based on pressure in the propulsion system. The vanes are designed to provide steering assistance when insufficient thrust is generated by the propulsion system to effectively steer the watercraft.

68 Claims, 16 Drawing Sheets

U.S. PATENT DOCUMENTS 4,149,469 A 4/1979 Bigler
4,175,721 A 11/1979 Lempa, Jr.
4,232,626 A 11/1980 Kern
4,323,027 A 4/1982 Schermerhorn
4,352,666 A 10/1982 McGowan
4,355,985 A 10/1982 Borst et al.
4,463,700 A 8/1984 Becker
4,583,030 A 4/1986 Nixon
4,615,290 A 10/1986 Hall
4,632,049 A 12/1986 Hall et al.
4,653,418 A 3/1987 Mori et al.
4,749,926 A 6/1988 Ontolchik
4,759,732 A 7/1988 Atsumi
4,762,079 A 8/1988 Takeuchi et al.
4,776,205 A 10/1988 Brooks et al.
4,776,295 A 10/1988 Kline et al.
4,779,553 A 10/1988 Wildhaber, Sr.
4,787,867 A 11/1988 Takeuchi et al.
4,854,259 A 8/1989 Cluett
4,908,766 A 3/1990 Takeuchi
4,949,662 A 8/1990 Kobayashi
4,961,396 A 10/1990 Sasagawa
4,964,821 A 10/1990 Tafoya
4,967,682 A 11/1990 O'Donnell
5,062,815 A 11/1991 Kobayashi
5,070,803 A 12/1991 Smith
5,085,603 A 2/1992 Haluzak
5,092,260 A 3/1992 Mardikian
5,094,182 A 3/1992 Simner
5,113,777 A 5/1992 Kobayashi
5,154,650 A 10/1992 Nakase
5,167,547 A 12/1992 Kobayashi et al.
5,193,478 A 3/1993 Mardikian
5,199,193 A 4/1993 Toyohara et al.
5,246,392 A 9/1993 Johnston
5,254,023 A 10/1993 Kobayashi
5,263,432 A 11/1993 Davis
5,310,369 A 5/1994 Kobayashi
5,350,325 A 9/1994 Nanami
5,375,551 A 12/1994 Lunter et al.
5,377,610 A 1/1995 Goebel
5,421,753 A 6/1995 Roos
5,474,007 A 12/1995 Kobayashi
5,494,464 A 2/1996 Kobayashi et al.
5,520,133 A 5/1996 Wiegert
5,607,332 A 3/1997 Kobayashi et al.
5,611,295 A 3/1997 Stables
5,718,611 A 2/1998 Schlangen et al.
5,755,601 A 5/1998 Jones
5,813,357 A 9/1998 Watson
6,032,605 A 3/2000 Takashima
6,086,437 A 7/2000 Murray

PERSONAL WATERCRAFT HAVING OFF-POWER STEERING SYSTEM

The present application claims priority to U.S. Provisional Appln. Ser. No. 60/375,401 dated Apr. 26, 2002 and is a continuation-in-part of U.S. application. Ser. No. 09/850,173 dated May 8, 2001 to Simard, now U.S. Pat. No. 6,523,484, which is a continuation-in-part of U.S. appln. of Simard, Ser. No. 09/775,806, dated Feb. 5, 2001 now abandoned, which claims priority to U.S. Provisional Appln. of Simard, Ser. No. 60/180,223, filed Feb. 4, 2000. The entirety of each of the above applications are hereby incorporated into the present application by reference.

BACKGROUND OF THE INVENTION

1. Field of the Invention

This invention relates to jet powered watercraft, especially personal watercraft ("PWC"). More specifically, the invention concerns control systems that assist in maneuvering jet powered watercraft when the jet pump fails to produce sufficient thrust to assist in directional control of the watercraft. In particular, the invention is directed to steering assistance for a PWC.

2. Description of Related Art

Jet powered watercraft have become very popular in recent years for recreational use and for use as transportation in coastal communities. The jet power offers high performance, which improves acceleration, handling, and shallow water operation. Accordingly, PWCs, which typically employ jet propulsion, have become common place, especially in resort areas.

As use of PWCs has increased, the desire for better performance and enhanced maneuverability has become strong. Operators need to be able to handle the watercraft in heavily populated areas, especially to avoid obstacles, other watercraft and swimmers. Also, as more people use PWCs as a mode of transportation, it is also preferred that the craft be easily docked and maneuvered in public places.

Typically, jet powered watercraft have a jet pump mounted within the hull that takes in water and expels the water at a high thrust to propel the watercraft. Most PWCs operate with this system. To control the direction of the watercraft, a nozzle is generally provided at the outlet of the jet pump to direct the thrust, or flow of pressurized water, in a desired direction. Turning is achieved by redirecting the thrust. In conventional, commercially available PWCs, the only mechanism provided for turning is the nozzle.

The nozzle is mounted on the rear of the craft and pivots such that the thrust may be selectively directed toward the port and starboard sides within a predetermined range of motion. The direction of the nozzle is controlled from the helm of the watercraft by the person operating the craft. By this, the operator can steer the watercraft in a desired direction. For example, when a PWC operator chooses to make a starboard-side turn, he or she turns the helm clockwise. This causes the nozzle to be directed to the starboard side of the PWC so that the thrust will effect a starboard turn.

During operation, when the user stops applying the throttle, the motor speed (measured in revolutions per minute or RPMs) drops, thus slowing or stopping the flow of water through the nozzle at the rear of the watercraft. This results in reducing the thrust generated by the pump. Accordingly, the water pressure in the nozzle drops. This is known as an "off-throttle" situation. This can occur at low vehicle speeds, for example when the operator is approaching shore or a dock, or at high vehicle speeds, when the operator releases the throttle.

Thrust will also be reduced if the user stops the engine by pulling the safety lanyard or pressing the engine kill switch. The same condition occurs in cases of engine failure (i.e., no fuel, ignition problems, etc.) and jet pump failure (i.e., rotor or intake jam, cavitation, etc.). These are known as "off-power" situations. For simplicity, throughout this application, the term "off-power" will also include "off-throttle" situations, since both situations have the same effect of reducing pump pressure and thus reducing thrust.

Since the flow of pressurized water is the thrust that causes the vehicle to turn, when the thrust is reduced or eliminated, steering becomes less effective. As a result, a need has developed to improve the steerability of PWCs under circumstances of insufficient thrust when the pressure generated by the pump has decreased below a predetermined threshold. This is particularly significant when docking or when driving through low wake areas. This is also important when the vehicle is operating at high speeds and the throttle is released, which would create a situation where steering assistance is needed.

One example of a prior art system is shown in U.S. Pat. No. 3,159,134 to Winnen, which provides a system where steering assistance is provided by vertical flaps positioned at the rear of the watercraft on either side of the hull. In this system, when travelling at low speeds, the thrust from the propulsion system provides minimal steering for the watercraft. When the operator turns the helm, one of the side flaps pivots outwardly from the hull into the flow of water with a flap bar to improve steering control. However, this system is not advantageous for several reasons discussed below.

A system similar to Winnen is schematically represented by FIG. 18, which shows a watercraft 1100 having a helm 114. Flaps 1116*a*, 1116*b* are attached to the sides of the hull via a flap bar 1128*a*, 1128*b* at a front edge. Two telescoping linking elements 1150*a*, 1150*b* are attached to arms 1151*a* and 1151*b*, respectively, at one end and to the respective flap bars 1128*a*, 1128*b* at the other end, respectively. Arms 1151*a*, 1151*b* are attached to partially toothed gears 1152*a*, 1152*b*, respectively. A central gear 1160 is positioned between the gears 1152*a* and 1152*b* to engage them, and is operated, through a linking element 1165 and a steering vane 1170, by the helm 1114. FIG. 18 illustrates the operation of the flaps when the watercraft is turning to the right, or starboard, direction.

Because the gears 1152*a*, 1152*b* are only partially toothed, when attempting a starboard turn, only the right gear 1152*b* will be engaged by the central gear 1160. Therefore, the left flap 1116*a* does not move but, rather, stays in a parallel position to the outer surface of the hull of the PWC 1100. Thus, in this configuration, the right flap 1116*b* is the only flap in an operating position to assist in the steering of the watercraft 1100.

While the steering system of FIG. 18 provides some level of improved steering control, the system suffers from certain deficiencies. First, steering is physically difficult. When the flap bars 1128 are located at the front portion of the flaps 1116 (as shown), the user must expend considerable effort to force the flaps 1116*a*, 1116*b* out into the flow of water. Second, the force needed to force the flaps 1116*a*, 1116*b* into the water stream causes considerable stress to be applied to the internal steering cabling system that may cause the cabling system to weaken to the point of failure. Third, only one flap 1116*b* is used at any given moment to assist in low speed steering. Therefore, steering assistance is provided on one side of the watercraft only. Fourth, when the helm is turned, the one usable flap is always operative. Thus, when the helm is turned while the watercraft is operating at a high speed, with sufficient thrust, the flap is pivoted into the high pressure flow of water past the hull. This can cause damage to the flap and its associated components and can make handling more aggressive.

Thus, the steering system shown in FIG. 18 is difficult to use, applies unacceptable stresses to the internal steering system, relies on only half of the steering flaps to effectuate a turn, and cannot be disengaged when steering assistance is not desired.

For at least these reasons, a need has developed for an off-power steering system that is more effective in steering a jet powered watercraft, especially a PWC, when the thrust is inadequate because the pump pressure has fallen below a predetermined threshold. Preferably, the steering system should provide accurate handling with easy operation.

SUMMARY OF THE INVENTION

Therefore, one aspect of embodiments of this invention provides an off-power steering system that does not cause undue stress on the driver or the helm control steering mechanisms.

An additional aspect of the present invention provides an off-power steering mechanism that does not interfere with operation of the watercraft when sufficient thrust is generated by the jet pump to steer the watercraft.

A further aspect of the present invention provides a high degree of maneuverability by providing supplemental steering assistance on both sides of the watercraft.

In summary, this invention is directed to an off power steering system for a personal watercraft comprising a hull, a deck mounted on the hull, and a jet propulsion system positioned in a tunnel of the hull and connected to a steering nozzle at the stem of the hull. The deck supports a straddle seat and a helm with steering handles. A movable vane is mounted on both sides of the hull and spaced a predetermined distance from the side wall of the hull. An actuator operatively connects the vanes and the helm so that the vanes are operable from the helm. The vanes act as mechanisms to deflect the flow of water adjacent to the hull, which causes the watercraft to change direction.

More particularly, this invention relates to a watercraft comprising a hull with an operator's area, a jet propulsion system supported by the hull, and a helm with a steering controller located in the operator's area. To assist with steering, a pair of vanes are supported on opposed sides of the hull for movement with respect to the hull. A first actuator is coupled between the steering controller and each of the vanes to transmit steering signals to at least one of the vanes to pivot the vane with respect to the hull. A second actuator is coupled between the jet propulsion system and each of the vanes to move the vane between a lowered, operative position and a raised, inoperative position.

Preferably, the watercraft is a personal watercraft (PWC). The PWC can be a straddle type seated PWC or a stand-up PWC. Additionally, the watercraft could be different types of jet powered watercraft, such as a jet boat, or even a watercraft powered by a conventional propeller driven system.

The watercraft can be powered by a jet propulsion system that includes a nozzle positioned at the outlet of the propulsion system that is operatively connected to the steering controller, so that the nozzle pivots in response to steering signals and directs the pressurized stream of water in a desired direction to effect turning. A first actuator in the form of a connector can be provided through the hull between the nozzle and the vanes to transmit steering signals from the nozzle to the vanes. The connector can have shock absorbing mechanisms to prevent or reduce the transmission of forces experienced by the vanes to the nozzle. Further, rather than using a nozzle, the steering of the watercraft could be effected by a rudder disposed at the outlet of the jet propulsion system.

The vanes are preferably pivotally connected adjacent to the stern of the watercraft, with one vane on each starboard and port side. Upon receiving a steering command, the vanes can pivot into the flow of water to deflect water and assist with steering. The vanes can be spaced from the hull wall to allow water to flow on both sides of the vane when in certain positions. The vanes can also be provided with through holes to allow water to pass through the vanes and grooves with fins to allow water to flow over the vanes to facilitate flow over the vanes and reduce stress to the vane structure.

The vanes can be moved from an operative position at or below the waterline to an inoperative position above the waterline, when the vanes are not needed, as determined based on the sufficiency of thrust provided by the jet propulsion system. When thrust is reduced or insufficient as evidenced by low pressure in the jet propulsion system, the vanes can be lowered, automatically or selectively, into an operative position.

Such movement can be effected by a second actuator in the form of a hydraulic system that raises or lowers the vanes in response to pressure generated in the pump. While the pressure can be transmitted by signals, it is preferred that the system includes a direct connection to the jet propulsion system. A hydraulic cylinder and piston rod associated with the mounting system of the vane can control the movement of the vane by moving the vane up by a pressure command or down by a spring biased response. A blocking device can be provided to limit downward movement of the vane. In that case, the vane will only move into the operative position when a steering command is received.

In summary, this invention is directed to a personal watercraft comprising a hull having a pair of side walls and bottom with a tunnel, a helm supported by the hull and having a steering member, and a jet propulsion unit supported by the hull in the tunnel and having an inlet that draws in water and an outlet that expels a pressurized stream of water as thrust that propels the personal watercraft. A nozzle is attached to the outlet and directs the pressurized stream of water in response to the steering member to steer the personal watercraft in a desired direction. A side vane is supported by each side wall of the hull. Each vane is operatively connected to the steering member to pivot with respect to the associated side wall in response to movement of the steering member and is operatively connected to the jet propulsion unit to raise and lower with respect to the side wall in response to pressure in the jet propulsion unit.

These and other aspects of this invention will become apparent upon reading the following disclosure in accordance with the Figures.

BRIEF DESCRIPTION OF THE DRAWINGS

An understanding of the various embodiments of the invention may be gained by virtue of the following Figures, of which like elements in various Figures will have common reference numbers, and wherein.

DETAILED DESCRIPTION OF PREFERRED EMBODIMENTS

The invention is described with reference to a PWC for purposes of illustration only. However, it is to be understood that the steering, stopping, and handling systems described herein can be utilized in any watercraft, particularly those crafts that are powered by a jet propulsion system, such as sport boats.

The general construction of a personal watercraft 10 in accordance with a preferred embodiment of this invention is shown in FIGS. 1–5. The following description relates to one way of manufacturing a personal watercraft according to a preferred design. Obviously, those of ordinary skill in the watercraft art will recognize that there are other known ways of manufacturing and designing watercraft and that this invention would encompass other known ways and designs.

Figure 1:
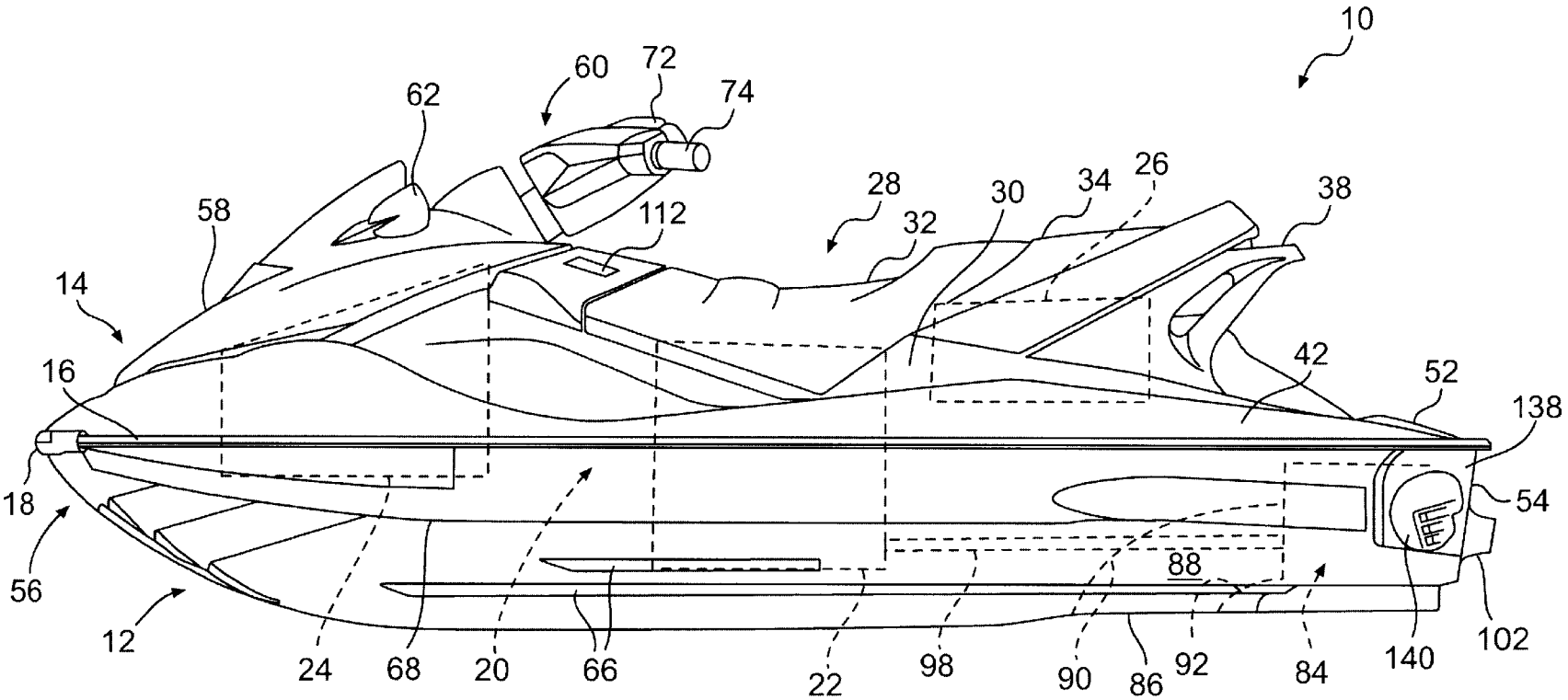
FIG. 1 illustrates a side view of a watercraft in accordance with the preferred embodiment of the invention.

The watercraft 10 of FIG. 1 is made of two main parts, including a hull 12 and a deck 14. The hull 12 buoyantly supports the watercraft 10 in the water. The deck 14 is designed to accommodate a rider and, in some watercraft, one or more passengers. The hull 12 and deck 14 are joined together at a seam 16 that joins the parts in a sealing relationship. Preferably, the seam 16 comprises a bond line formed by an adhesive. Of course, other known joining methods could be used to sealingly engage the parts together, including but not limited to thermal fusion, molding or fasteners such as rivets or screws. A bumper 18 generally covers the seam 16, which helps to prevent damage to the outer surface of the watercraft 10 when the watercraft 10 is docked, for example. The bumper 18 can extend around the bow, as shown, or around any portion or all of the seam 16.

The space between the hull 12 and the deck 14 forms a volume commonly referred to as the engine compartment 20 (shown in phantom). Shown schematically in FIG. 1, the engine compartment 20 accommodates an engine 22, as well as a muffler, tuning pipe, gas tank, electrical system (battery, electronic control unit, etc.), air box, storage bins 24, 26, and other elements required or desirable in the watercraft 10. One of the challenges of designing the watercraft 10 is to fit all of these elements into the relatively small volume of the engine compartment 20.

Figure 2:
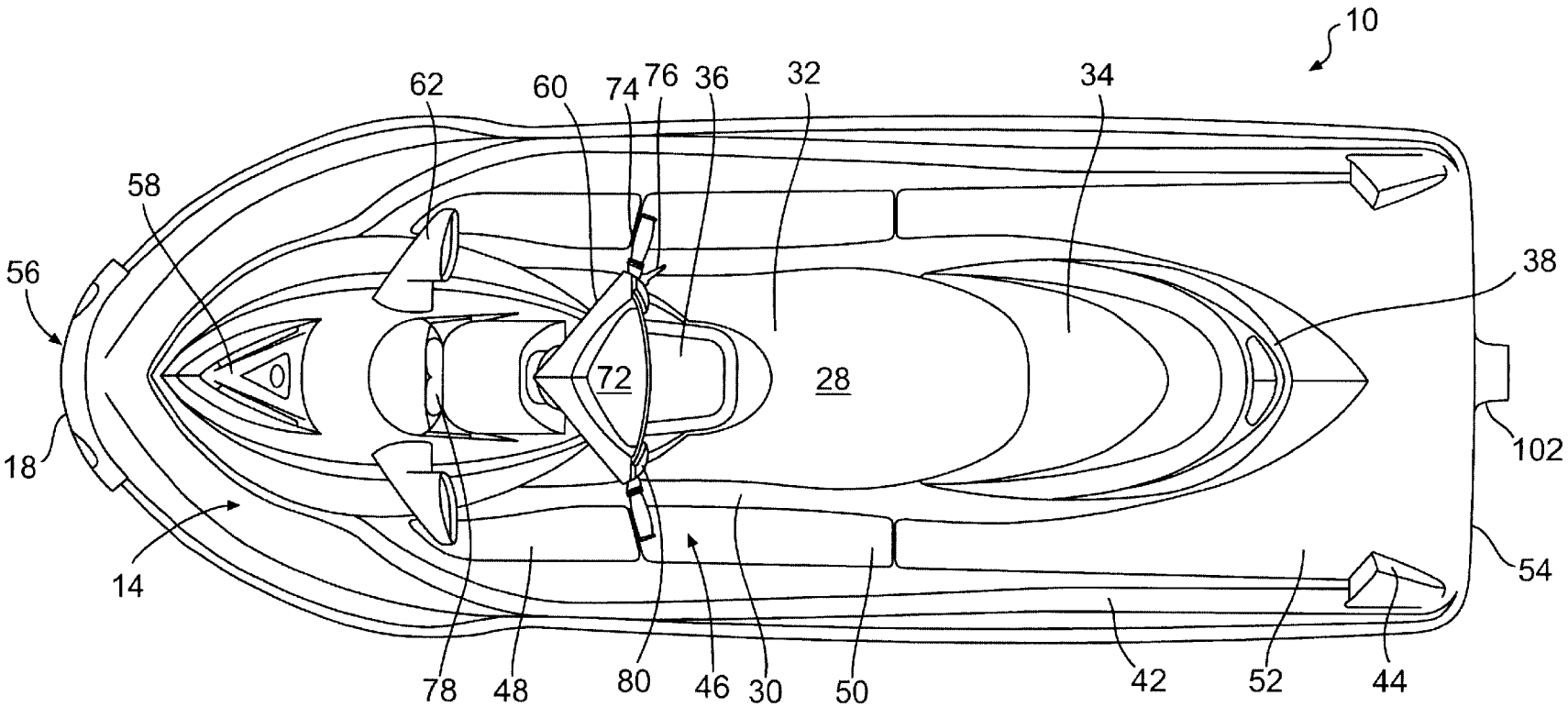
FIG. 2 is a top view of the watercraft of FIG. 1.

As seen in FIGS. 1 and 2, the deck 14 has a centrally positioned straddle-type seat 28 positioned on top of a pedestal 30 to accommodate a rider in a straddling position. The seat 28 may be sized to accommodate a single rider or sized for multiple riders. For example, as seen in FIG. 2, the seat 28 includes a first, front seat portion 32 and a rear, raised seat portion 34 that accommodates a passenger. The seat 28 is preferably made as a cushioned or padded unit or interfitting units. The first and second seat portions 32, 34 are preferably removably attached to the pedestal 30 by a hook and tongue assembly (not shown) at the front of each seat and by a latch assembly (not shown) at the rear of each seat, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) can cover a removable storage box 26 (FIG. 1). A "glove compartment" or small storage box 36 may also be provided in front of the seat 28.

Figure 4:
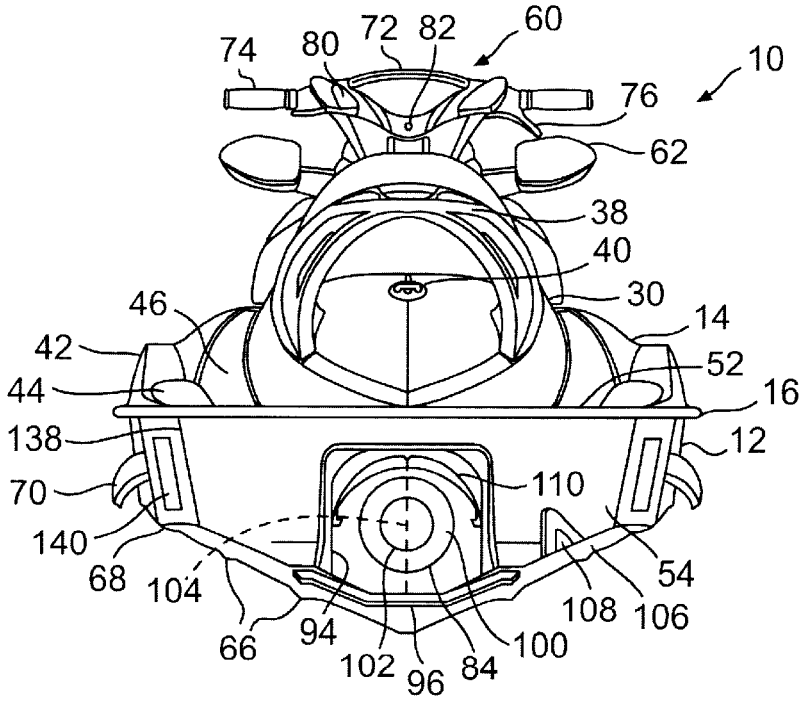
FIG. 4 is a back view of the watercraft of FIG. 1.

As seen in FIG. 4, a grab handle 38 may be provided between the pedestal 30 and the rear of the seat 28 to provide a handle onto which a passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the rider's feet, and also provide buoyancy when turning the watercraft 10, since personal watercraft roll slightly when turning. Towards the rear of the watercraft 10, the gunnels 42 extend inwardly to act as heel rests 44. Heel rests 44 allow a passenger riding the watercraft 10 facing towards the rear, to spot a water-skier for example, to place his or her heels on the heel rests 44, thereby providing a more stable riding position. Heel rests 44 could also be formed separate from the gunnels 42.

Located on both sides of the watercraft 10, between the pedestal 30 and the gunnels 42 are the footrests 46. The footrests 46 are designed to accommodate a rider's feet in various riding positions. To this effect, the footrests 46 each have a forward portion 48 angled such that the front portion of the forward portion 48 (toward the bow of the watercraft 10) is higher, relative to a horizontal reference point, than the rear portion of the forward portion 48. The remaining portions of the footrests 46 are generally horizontal. Of course, any contour conducive to a comfortable rest for the rider could be used. The footrests 46 may be covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering may cover the reboarding platform 52. A retractable ladder (not shown) may be affixed to the transom 54 to facilitate boarding the watercraft 10 from the water onto the reboarding platform 52.

Figure 3:
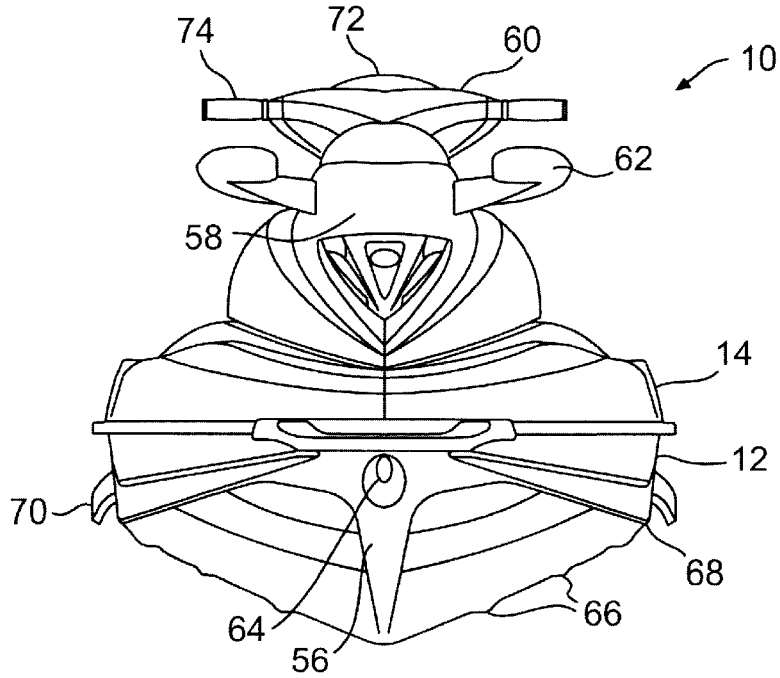
FIG. 3 is a front view of the watercraft of FIG. 1.

Referring to the bow 56 0f the watercraft 10, as seen in FIGS. 2 and 3, watercraft 10 is provided with a hood 58 located forwardly of the seat 28 and a helm assembly 60. A hinge (not shown) is attached between a forward portion of the hood 58 and the deck 14 to allow hood 58 to move to an open position to provide access to the front storage bin 24 (FIG. 1). A latch (not shown) located at a rearward portion of hood 58 locks hood 58 into a closed position. When in the closed position, hood 58 prevents water from entering front storage bin 24. Rearview mirrors 62 are positioned on either side of hood 58 to allow the rider to see behind. A hook 64 is located at the bow 56 of the watercraft 10. The hook 64 is used to attach the watercraft 10 to a dock when the watercraft is not in use or to attach to a winch when loading the watercraft on a trailer, for instance.

Figure 5:
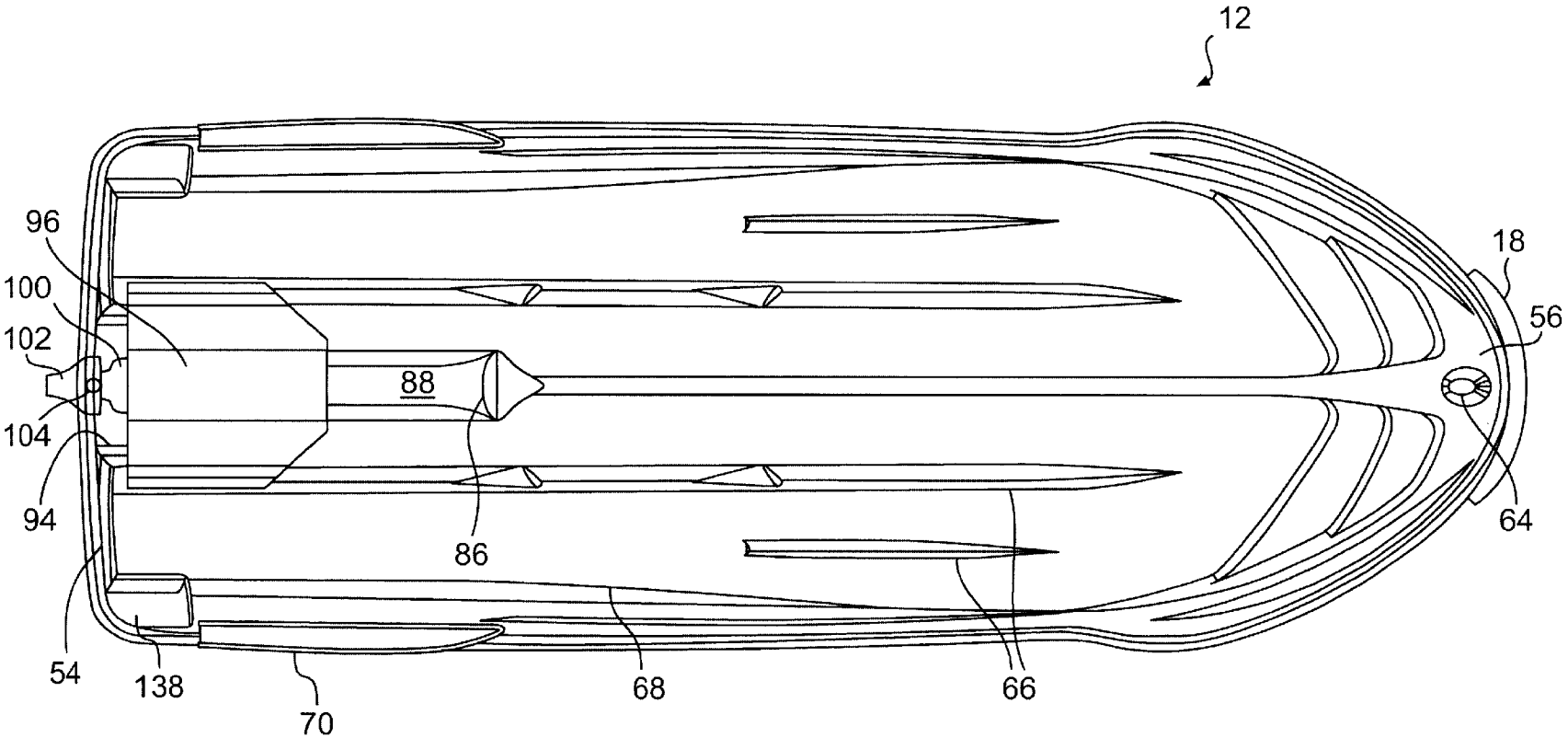
FIG. 5 is a bottom view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 preferably have an arcuate undersurface that gives the watercraft 10 both lift while in motion and improved turning characteristics. The sponsons are preferably fixed to the surface of the hull 12 and can be attached to the hull by fasteners or molded therewith. Sometimes it may be desirable to adjust the position of the sponson 70 with respect to the hull 12 to change the handling characteristics of the watercraft 10 and accommodate different riding conditions. Trim tabs, which are commonly known, may also be provided at the transom and may be controlled from the helm 60.

As best seen in FIGS. 3 and 4, the helm assembly 60 is positioned forwardly of the seat 28. The helm assembly 60 has a central helm portion 72, that may be padded, and a pair of steering handles 74, also referred to as a handle bar. One of the steering handles 74 is preferably provided with a throttle lever 76, which allows the rider to control the speed of the watercraft 10. As seen in FIG. 2, a display area or cluster 78 is located forwardly of the helm assembly 60. The display cluster 78 can be of any conventional display type, including a liquid crystal display (LCD), dials or LED (light emitting diodes). The central helm portion 72 may also have various buttons 80, which could alternatively be in the form of levers or switches, that allow the rider to modify the display data or mode (speed, engine rpm, time . . . ) on the display cluster 78 or to change a condition of the watercraft 10, such as trim (the pitch of the watercraft).

The helm assembly 60 may also be provided with a key receiving post 82, preferably located near a center of the central helm portion 72. The key receiving post 82 is adapted to receive a key (not shown) that starts the watercraft 10. As is known, the key is typically attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84 or jet pump. As known, the jet propulsion system 84 pressurizes water to create thrust. The water is first scooped from under the hull 12 through an inlet 86, which preferably has a grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

From the intake ramp 88, water enters the jet propulsion system 84. The jet propulsion system 84 is located in a formation in the hull 12, referred to as the tunnel 94. The tunnel 94 is defined at the front, sides, and top by the hull 12 and is open at the transom 54. The bottom of the tunnel 94 is closed by the ride plate 96. The ride plate 96 creates a surface on which the watercraft 10 rides or planes at high speeds.

The jet propulsion system 84 includes a jet pump that is made of two main parts: the impeller (not shown) and the stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet propulsion system 84, it goes through a venturi 100. Since the venturi's exit diameter is smaller than its entrance diameter, the water is accelerated further, thereby providing more thrust. A steering nozzle 102 is pivotally attached to the venturi 100 so as to pivot about a vertical axis 104. The steering nozzle 102 could also be supported at the exit of the tunnel 94 in other ways without a direct connection to the venturi 100. Moreover, the steering nozzle 102 can be replaced by a rudder or other diverting mechanism disposed at the exit of the tunnel 94 to selectively direct the thrust generated by the jet propulsion system 84 to effect turning.

The steering nozzle 102 is operatively connected to the helm assembly 60 preferably via a push-pull cable (not shown) such that when the helm assembly 60 is turned, the steering nozzle 102 pivots. This movement redirects the pressurized water coming from the venturi 100, so as to redirect the thrust and steer the watercraft 10 in the desired direction. Optionally, the steering nozzle 102 may be gimbaled to allow it to move around a second horizontal pivot axis (not shown). The up and down movement of the steering nozzle 102 provided by this additional pivot axis is known as trim and controls the pitch of the watercraft 10.

When the watercraft 10 is moving, its speed is measured by a speed sensor 106 attached to the transom 54 of the watercraft 10. The speed sensor 106 has a paddle wheel 108 that is turned by the water flowing past the hull. In operation, as the watercraft 10 goes faster, the paddle wheel 108 turns faster in correspondence. An electronic control unit (not shown) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used, as would be readily recognized by one of ordinary skill in the art.

The watercraft 10 may be provided with the ability to move in a reverse direction. With this option, a reverse gate 110, seen in FIG. 4, is used. The reverse gate 110 is pivotally attached to the sidewalls of the tunnel 94 or directly on the venturi 100 or the steering nozzle 102. To make the watercraft 102 move in a reverse direction, the rider pulls on a reverse handle 112 (FIG. 1) operatively connected to the reverse gate 110. The reverse gate 110 then pivots in front of the outlet of the steering nozzle 102 and redirects the pressurized water leaving the jet propulsion system 84 towards the front of the watercraft, thereby thrusting the watercraft 10 rearwardly. The reverse handle 112 can be located in any convenient position near the operator, for example adjacent the seat 28 as shown or on the helm 60.

Figure 6:
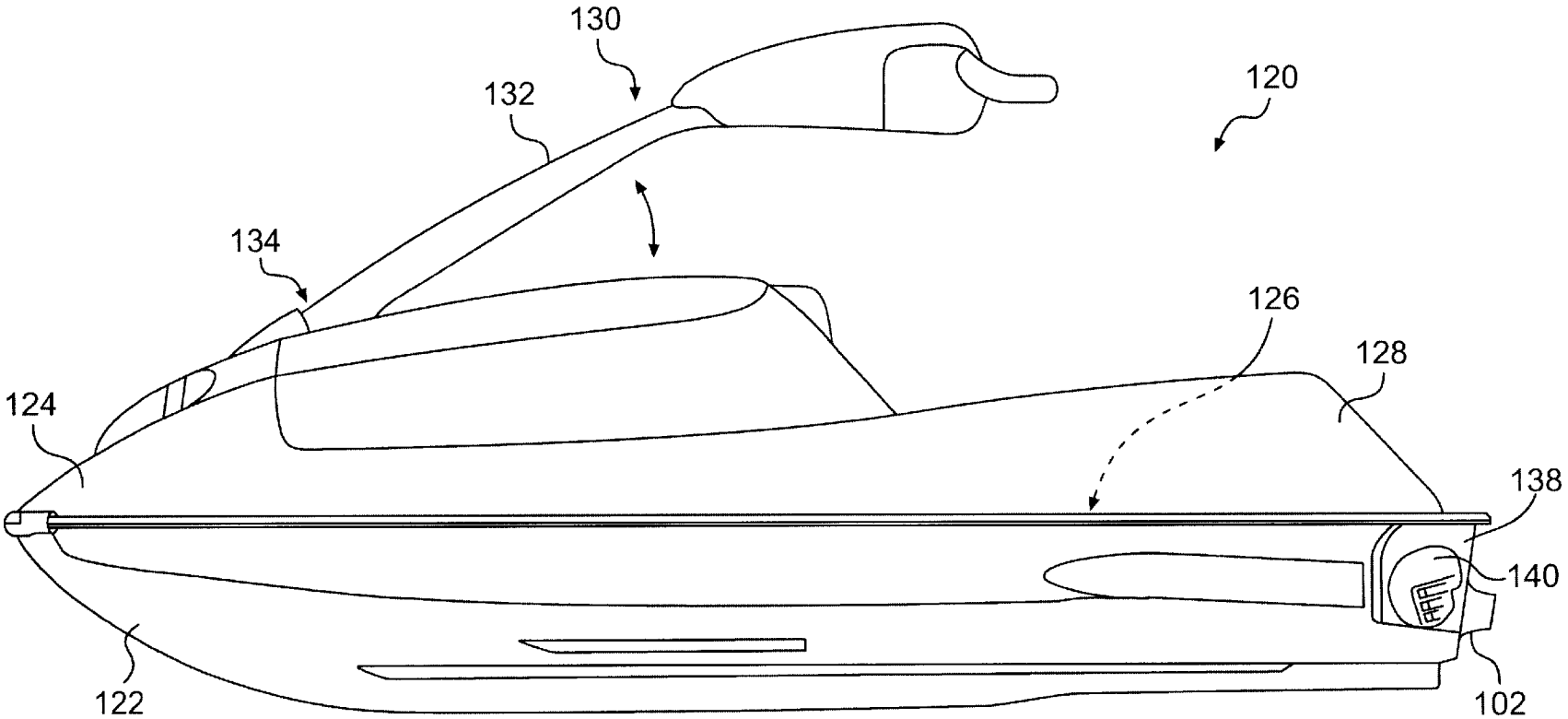
FIG. 6 illustrates an alternative stand-up type watercraft.

Alternatively, this invention can be embodied in a stand-up type personal watercraft 120, as seen in FIG. 6. Stand-up watercraft 120 are often used in racing competitions and are known for high performance characteristics. Typically, such stand-up watercraft 120 have a lower center of gravity and a hull 122 having multiple concave portions. The deck 124 may also have a lower profile. In this watercraft 120, the seat is replaced with a standing platform 126. The operator stands on the platform 126 between the gunnels 128 to operate the watercraft. The steering assembly 130 is configured as a pivoting handle pole 132 that tilts up from a pivot point 134 during operation, as shown in FIG. 6. At rest, the handle pole 132 folds downwardly against the deck 124 toward the standing platform 126. Otherwise, the components and operation of the watercraft 120 are similar to watercraft 10.

Referring again to FIGS. 1, 4, 5, and 6, a depression 138 is formed on each side of the hull 12 at the stern of the watercraft 10 near the transom 54. The depression 138 forms a recess in each side of the hull 12. As seen in detail in FIG. 7, a pair of side vanes 140 is attached to each side of the hull 12 in the depressions 138. As the vanes on each side are mirror images of each other, only one vane is described herein for purposes of simplicity.

The side vanes 140 constitute the assisted steering system of this invention. The term "vane" is intended to be a generic term to describe a flap, rudder, or other type of mechanism that can be operated to divert the flow of water and thus assist in turning a watercraft. A vane in accordance with this invention is preferably a generally plate like member that is shaped hydrodynamically. In the preferred embodiment described below, the vane experiences the flow of water across both inner and outer sides.

As an overview, the operation of a jet propelled watercraft 10 is described above with respect to the thrust provided by the water exiting the jet propulsion system 84 that moves the watercraft 10 in a desired direction with the assistance of the steering nozzle 102. It can be understood that if insufficient thrust is produced by the jet propulsion system 84, as described above as an off power situation, it can be difficult to direct the watercraft in the desired direction. The side vanes 140 of this invention provide a mechanism by which the watercraft 10 can be directed in the desired direction when insufficient thrust is being produced by the jet propulsion system 84. The side vanes 140 are preferably triggered by the helm 60 and can be activated in response to the pressure generated within the jet propulsion system 84, as described in detail below.

Figure 7:
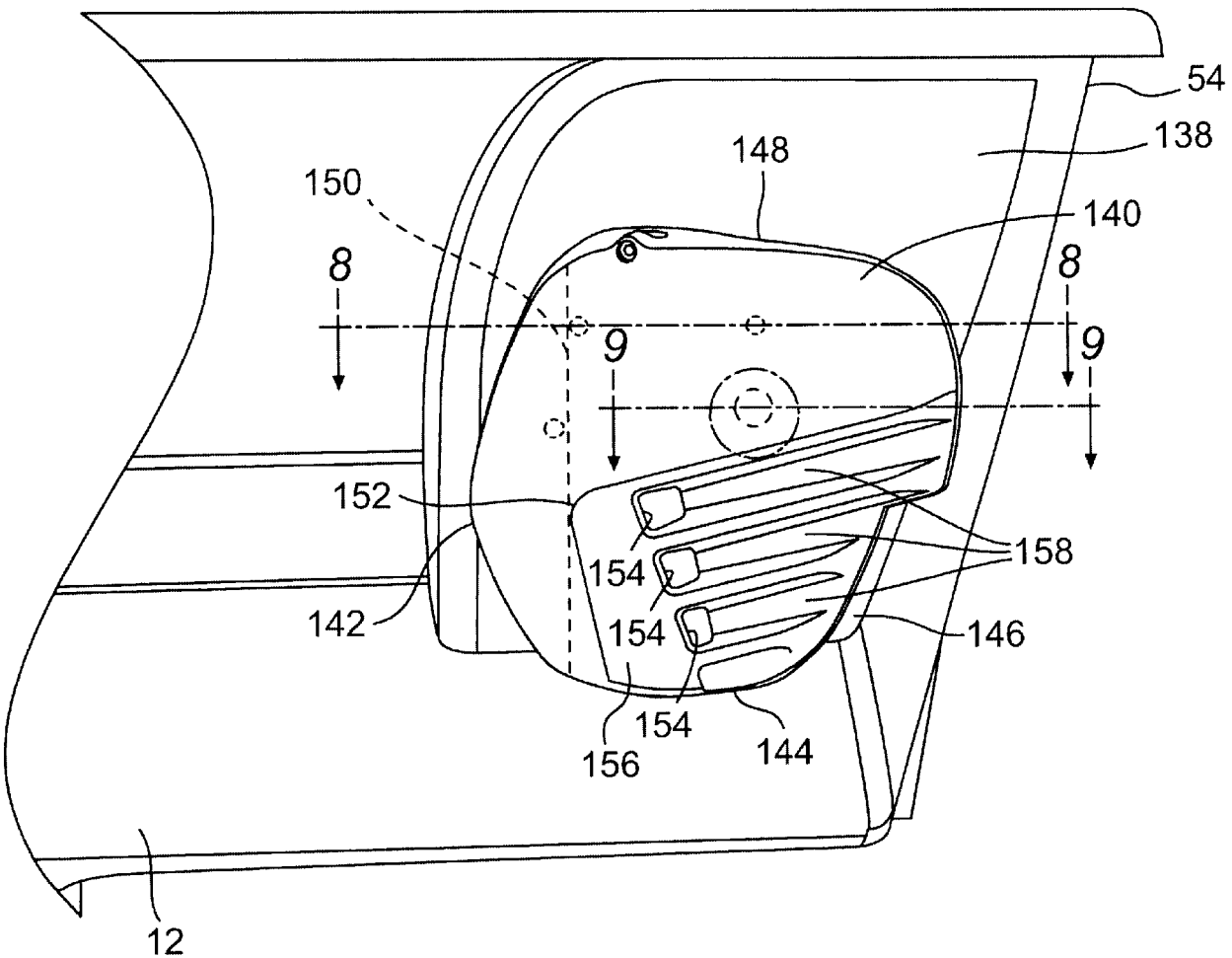
FIG. 7 is an enlarged partial side view of the stern of the watercraft of FIG. 1 having a side vane in accordance with the preferred embodiment of the invention.

As seen in FIG. 7, the side vane 140 is formed as a generally plate like member with rounded edges and an outer convex surface. The leading edge 142 of the vane 140 is gently pointed and curves back slightly to the bottom surface 144. This shape assists in deflecting floating obstacles, such as a rope, under the vane 140 or to help move the vane 140 up over solid obstacles, such as a rock, to avoid entangling or damaging the vane 140. The trailing edge 146 of the bottom surface 144 of the vane 140 curves upwardly as well. This curve accelerates the flow of the water following the bottom surface 144, thus creating a low pressure region. This low pressure region assists in moving the vane 140 into an operative position. The top surface 148 curves at both the leading edge 142 and the trailing edge 146 and tapers slightly from the leading edge 142 to the trailing edge 146 to enhance the flow of water over the vane 140.

Figure 8:
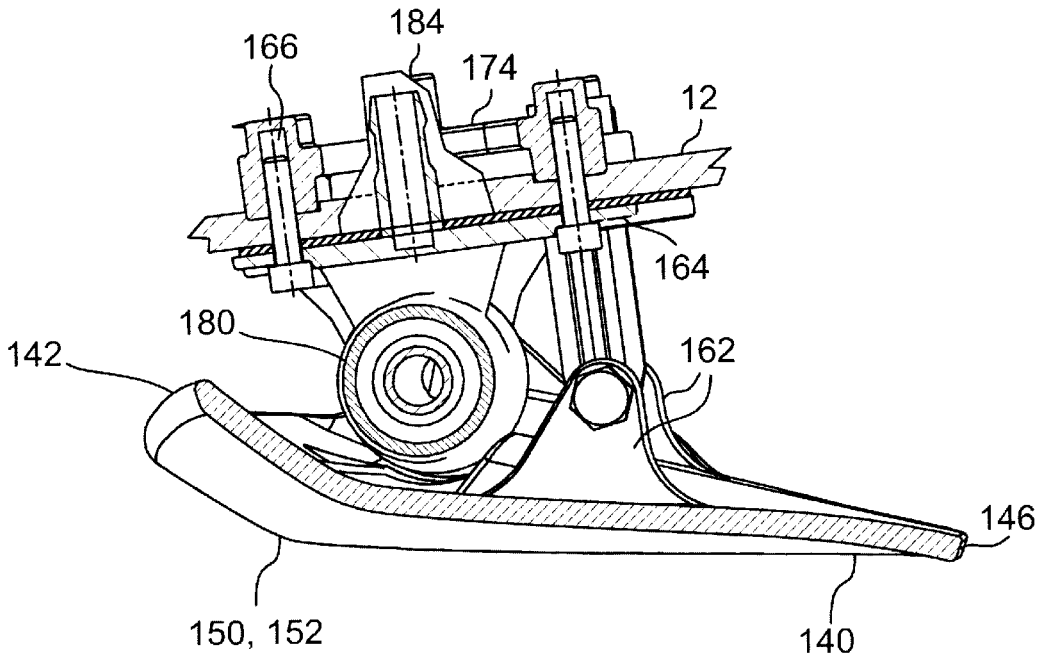
FIG. 8 is a top view in partial section of the vane of FIG. 7 taken along line 8—8.
Figure 9:
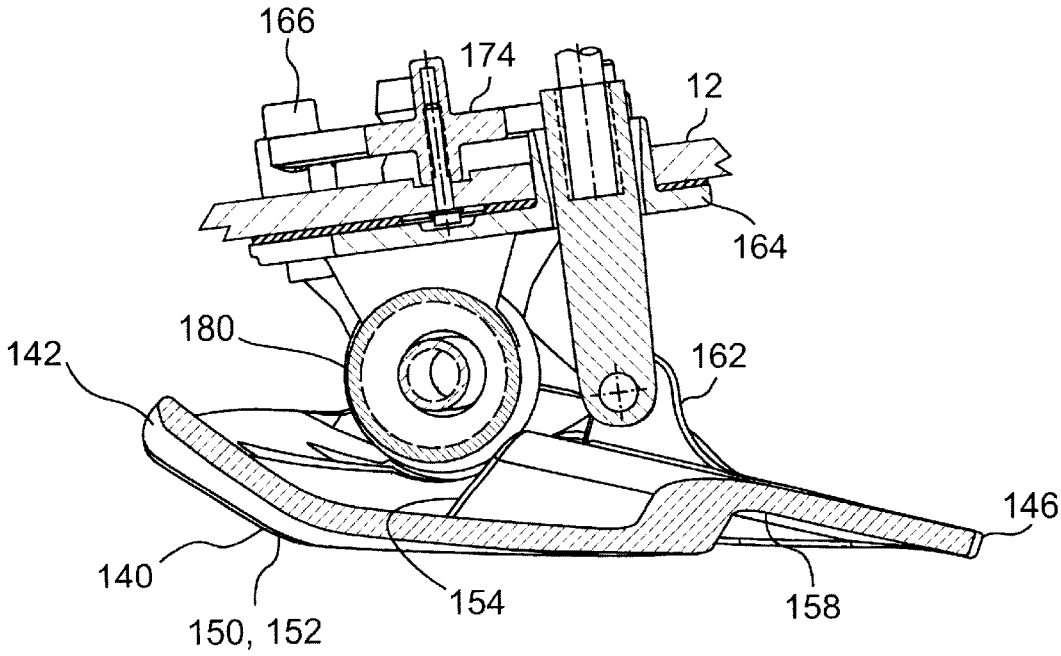
FIG. 9 is a top view in partial section of the vane of FIG. 7 taken along line 9—9.

The outer surface, which is generally smooth, has a generally vertical bend 150 positioned closer to the leading edge 142, as seen in FIGS. 8 and 9, which provides the vane 140 with an airfoil shape. About half way down the outer surface of the vane 140 or slightly below, the outer surface protrudes outwardly in a shallow convex shape, thus forming a slightly peaked area, shown generally at 152 in FIG. 7. This shape also facilitates water flow over the vane 140, especially when the vane 140 is raised from or lowered into the water. Of course, any suitable shape may be used for the vane, particularly airfoil shapes that enhance the flow of water over the vane without creating undue turbulence or interference. The shape described in detail herein is meant as an exemplary embodiment and is not intended to be limiting.

Figure 17:
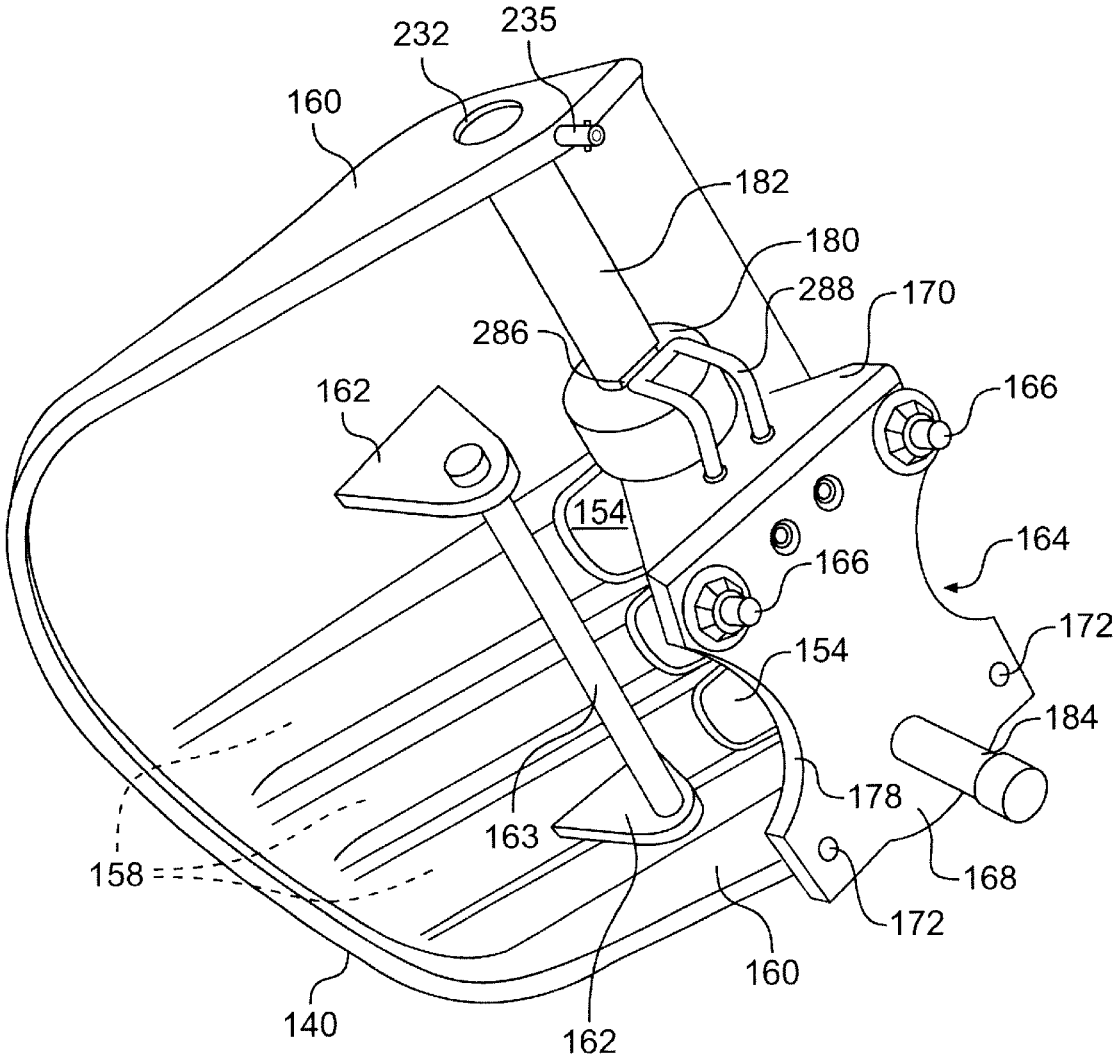
FIG. 17 is an isometric view of the back of vane mounted on the hydraulic cylinder with another embodiment of a limiting mechanism.
Figure 18:
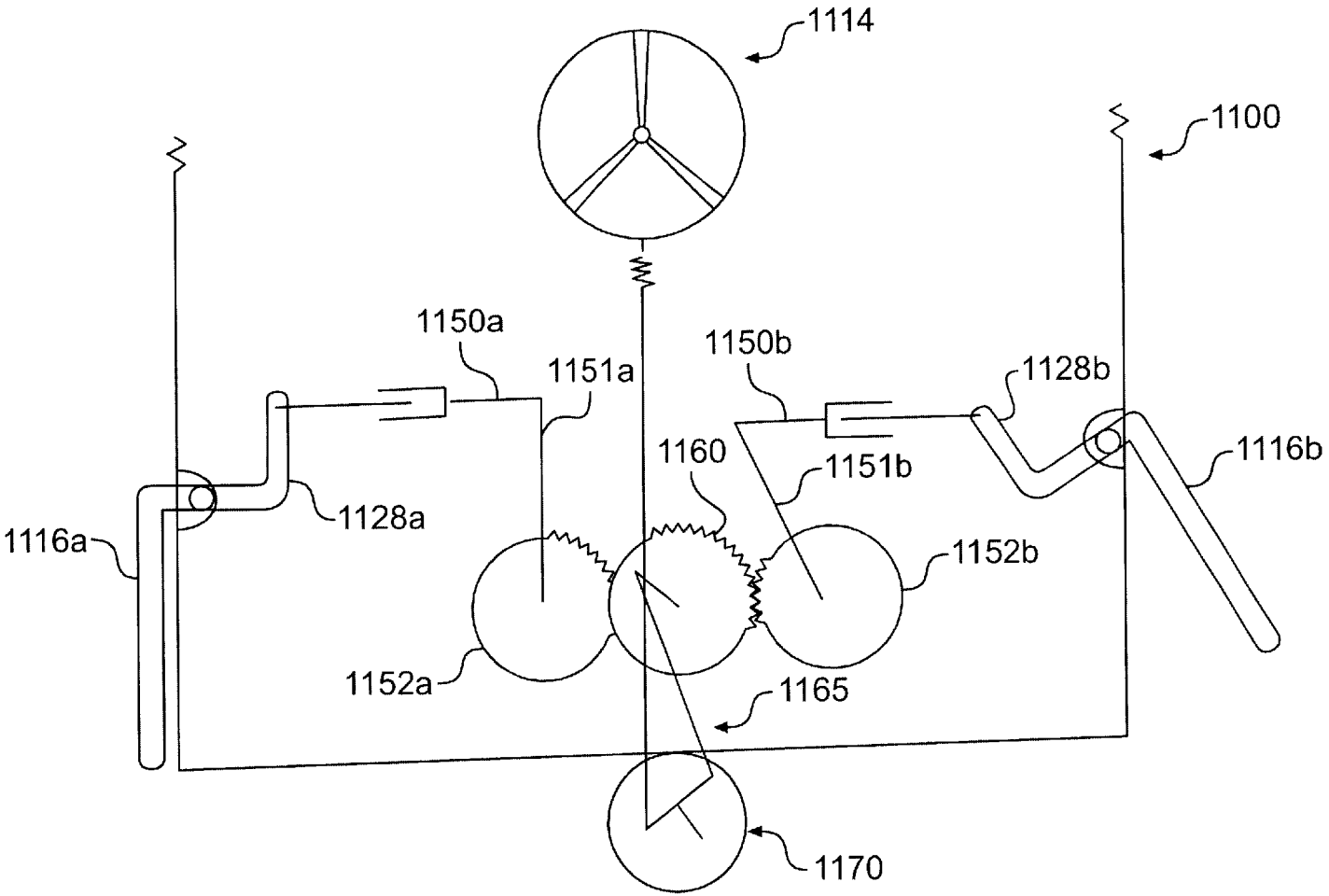
FIG. 18 PRIOR ART
FIG. 18 is a schematic view of a prior art system that uses hinge mounted flaps.

Preferably, each vane 140 has a plurality of openings 154 in its outer face. The openings 154 are positioned in a recessed area 156 in the outer surface, preferably in the lower portion of the vane 140. The openings 154 are oriented at an angle to the outer surface of the vane 140, as seen in FIGS. 9 and 17. Extending from the base of each opening 154 is a shallow groove 158. The series of grooves 158 create fins therebetween that extend upwardly toward the upper trailing edge 146 of the vane 140, as seen in FIG. 1. As seen in FIGS. 8, 9, and 17, the grooves 158 protrude outwardly from the inner surface of the vane 140, which is normally oriented to face the hull 12.

The openings 154 enable the vane 140 to be turned in such a way that may be effective in diverting water either on its outer surface or on its inner surface. When the vane 140 is positioned at an angle outward from the hull 12, water can flow through the openings 154 and within the grooves 158 both to relieve pressure upon the vane 140 (and the assembly connecting the vane 140 to the hull 12) and to allow the vane 140 to participate in diverting enough water to assist in steering the watercraft 10. In this situation, the vane 140 on the opposite side of the hull 12 will be positioned at an angle inward toward the hull 12. By this, water will flow through the openings 154 from the inner surface to the outer surface and up the grooves 158. This assists in maintaining the vane 140 in an operative position and in the desired turning position. In this manner, each vane 140 may more fully participate in steering the watercraft whether water flows across the outer surface or both the outer and inner surfaces.

The top surface 148 and the bottom surface 144 of each vane 140 have a flange 160 (the top flange being shown in FIG. 10 and both flanges being shown in FIG. 17) that extend inwardly to provide a mounting or connecting surface, which forms the pivot axis for the vane 140. The rear surface of the vane 140 also has a pair of support tabs 162 that are vertically aligned. A pivot rod 163 is retained between the tabs 162, as seen in FIG. 17.

Figure 11:
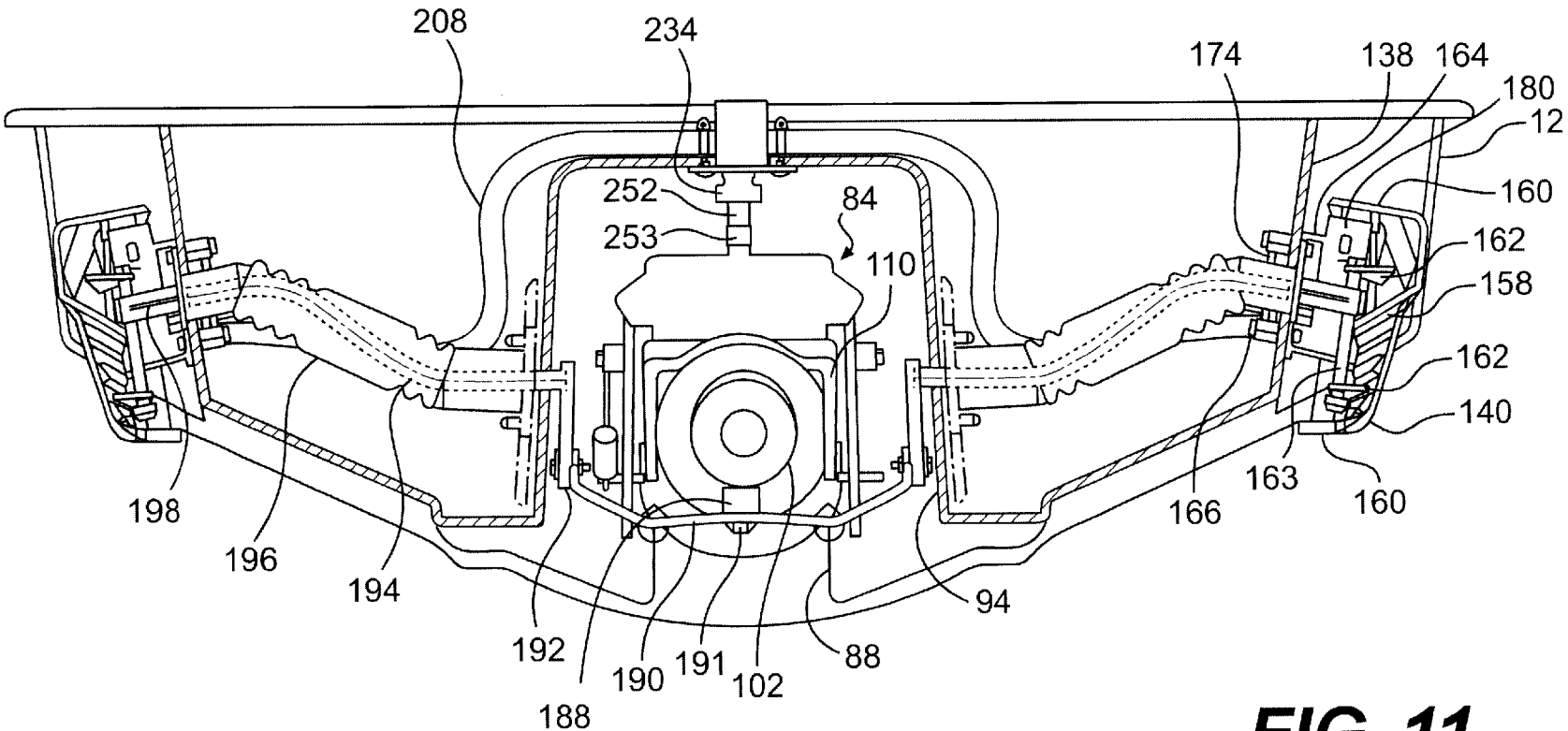
FIG. 11 is a back view in partial section of the stern of the hull of the watercraft showing the propulsion system and operating system of the side vanes.
Figure 14:
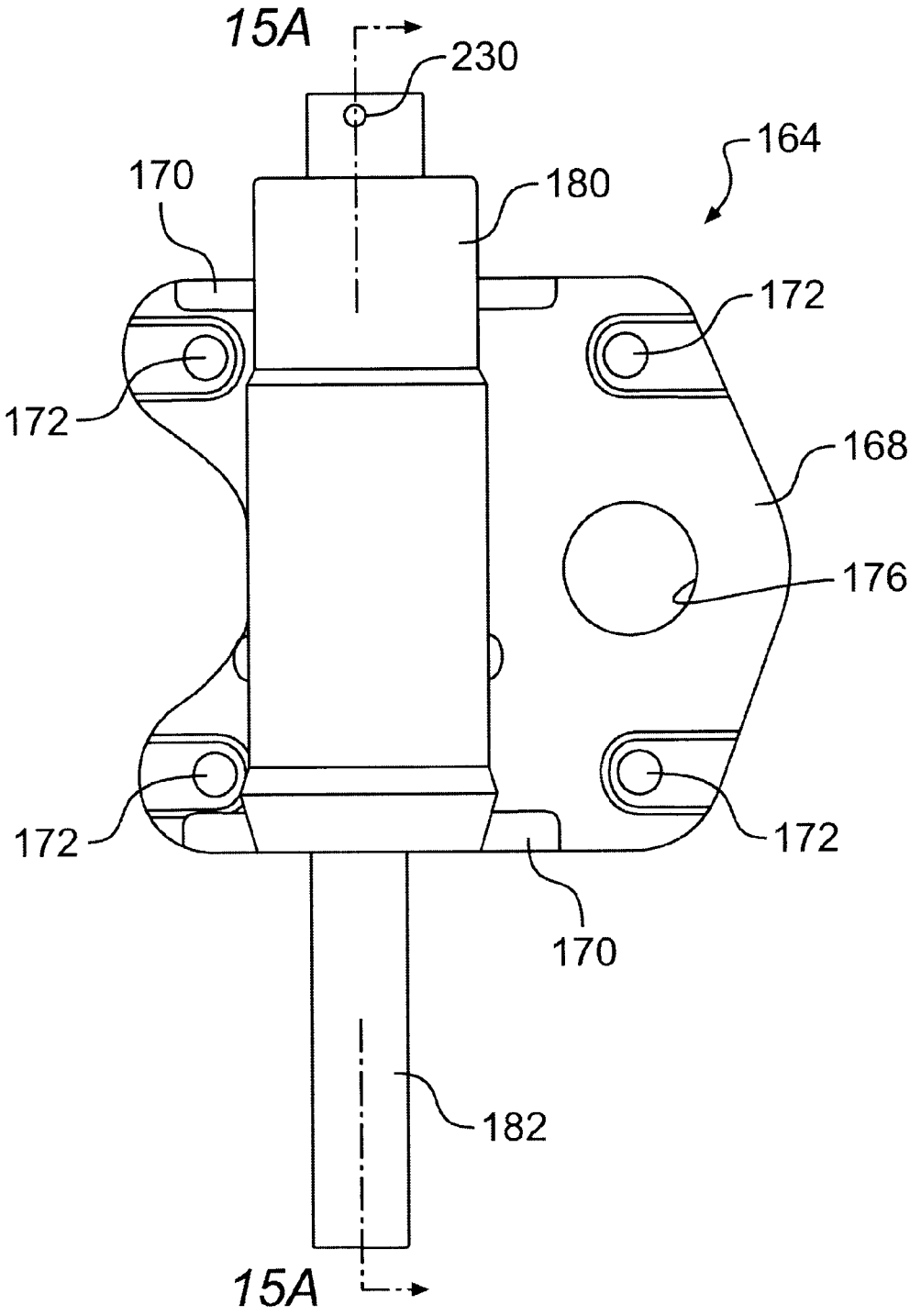
FIG. 14 is an enlarged side view of the hydraulic component and bracket associated with a vane.

Each vane 140 is attached to the hull 12 in depression 138 on each side with a bracket 164, best seen in FIGS. 11, 14 and 17. As will be recognized by one of ordinary skill, the depressions 138 are not necessary to the operation of the side vanes 140 or to the invention as a whole, as described below. However, it is preferred that the side vanes 140 be recessed for protection. The bracket 164 is roughly rectangular in the preferred embodiment, but of course could be formed as any shape suitable to form a secure connection to the hull 12.

Figure 10:
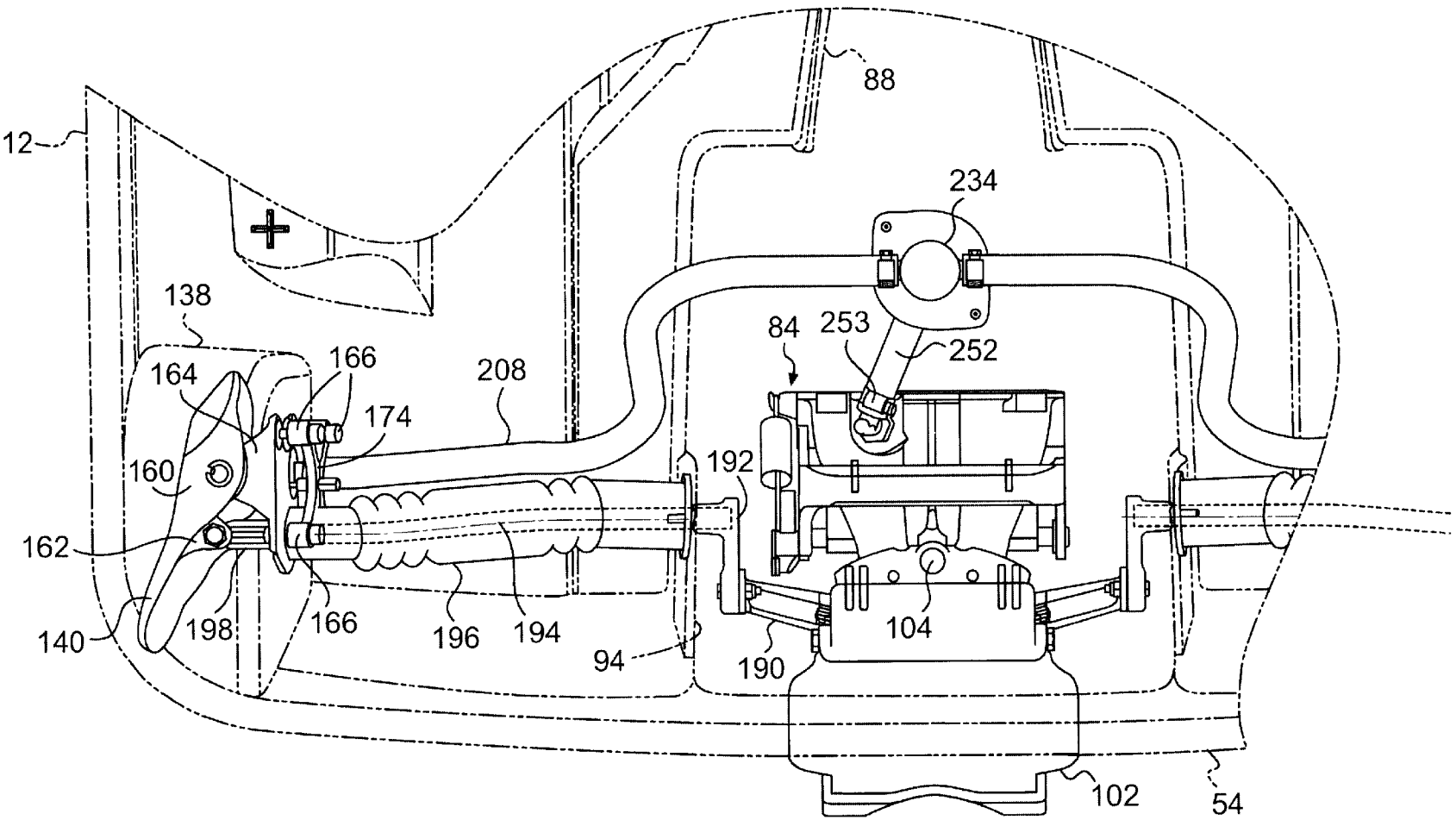
FIG. 10 is a partial top view of the stern of the watercraft with the hull shown in phantom illustrating the operating system of one of the side vanes in accordance with the preferred embodiment.
Figures 15A, 15B, 15C:
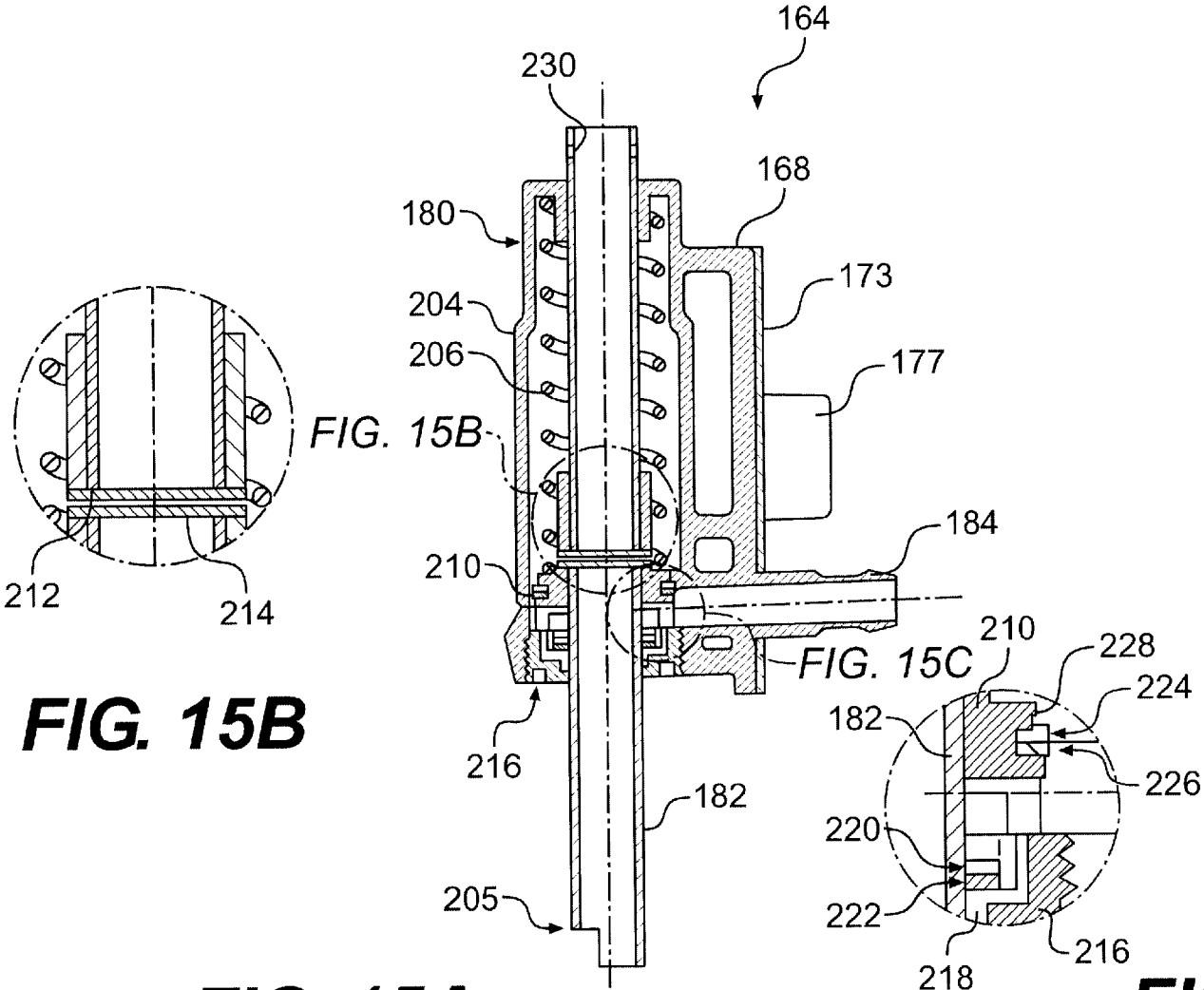
FIG. 15A is a cross section of the hydraulic component and bracket of FIG. 14.
FIG. 15B is an enlarged view of the circled section indicated in FIG. 15A.
FIG. 15C is an enlarged view of the circled section indicated in FIG. 15A.

The bracket 164 is formed of a face plate 168 and a pair of generally parallel flanges 170 that extend outwardly from the face plate 168. A plurality of apertures 172 are provided in the face plate 168, as seen in FIG. 14. As seen in FIGS. 10 and 17, the bracket 164 is fastened to the hull 12 by a plurality of fasteners 166, four bolts for example, that extend through the apertures 172 to form a stable and secure connection. A rear support structure 174 can be used, if desired, in association with the fasteners 166 within the hull 12 for added stability and orientation assistance. Also, a sealing member 173, such as a sheet of rubber, seen in FIG. 15A, may be provided to ensure that the bracket 164 is sealed to the hull and water is prevented from entering the hull through the various apertures in the face plate 168. Preferably, the face plate 168 has a cut out 176, as seen in FIG. 14 (the purpose of which will be explained below.) Alternatively, the face plate could have an annular conduit 177 extending from the cut out 176, as seen in FIG. 15A, or the face plate 168 could be cut away at the side 178, as seen in FIG. 17.

Each vane 140 is directly supported by a hydraulic cylinder 180 and a movable piston rod 182, which are retained by the flanges 170 of the bracket 164. A fluid port 184, best seen in FIGS. 8 and 17, extends through the face plate 168 of the bracket 164 into the hydraulic cylinder 180. The piston rod 182 is rotatably connected to the flanges 160 of the vane 140 thereby pivotally connecting the vane 140 to the bracket 164. The vane 140 pivots about the vertical axis defined by the piston rod 182 with respect to the hull 12.

Referring now to FIGS. 10 and 11, the operating system of the invention is described in detail. To operate, the vanes 140 cooperate with the steering system and the propulsion system to move in two ways. First, the vanes 140 are operatively connected to the helm 60 so that steering motion is translated to the vanes 140 to cause the vanes 140 to pivot with respect to the respective side of the hull 12. Second, the vanes 140 are operatively connected to the jet propulsion system 84 to raise into an inoperative position and lower into an operative position based on thrust generated by the jet propulsion system 84. It can be appreciated by those of ordinary skill in the art that there are a variety of ways to achieve such cooperation between the systems. A preferred way is described below, but the following description is intended to be illustrative not limiting.

As described above, the steering nozzle 102 is positioned at the outlet of the jet propulsion system 84. The steering nozzle 102 is operatively connected to helm 60 so that turning the steering handles 74 transmits movement to the steering nozzle 102. This is accomplished by a cable connection that extends through the hull 12. However, any known method of communicating movement including a gear assembly or electrical signal indicative of the steering command could also be employed.

The steering nozzle 102 is also connected to the vanes 140 through a connecting rod 194, as follows. A generally U-shaped yoke 190 made of a rigid material is pivotally attached to the underside of the nozzle 102 so that movement of the nozzle 102 creates a corresponding movement of the yoke 190. Specifically, pivotal movement of the nozzle 102 shifts the yoke 190 generally laterally. For example, pivoting the nozzle 102 clockwise shifts the yoke 190 laterally to the port side of the watercraft 10, while pivoting the nozzle 102 counterclockwise shifts the yoke 190 laterally to the starboard side of the watercraft 10. The pivotal connection is created by a bolt 191 surrounded by a sleeve 188 that is inserted through a bore in the center of the yoke 190. The sleeve 188 abuts against the underside of the nozzle 102 and allows the yoke 190 to slide vertically along the exterior of the sleeve 188 so that vertical force components applied to the yoke 102, during a trimming operation for example, are not transmitted directly to the nozzle 102.

Figure 13:
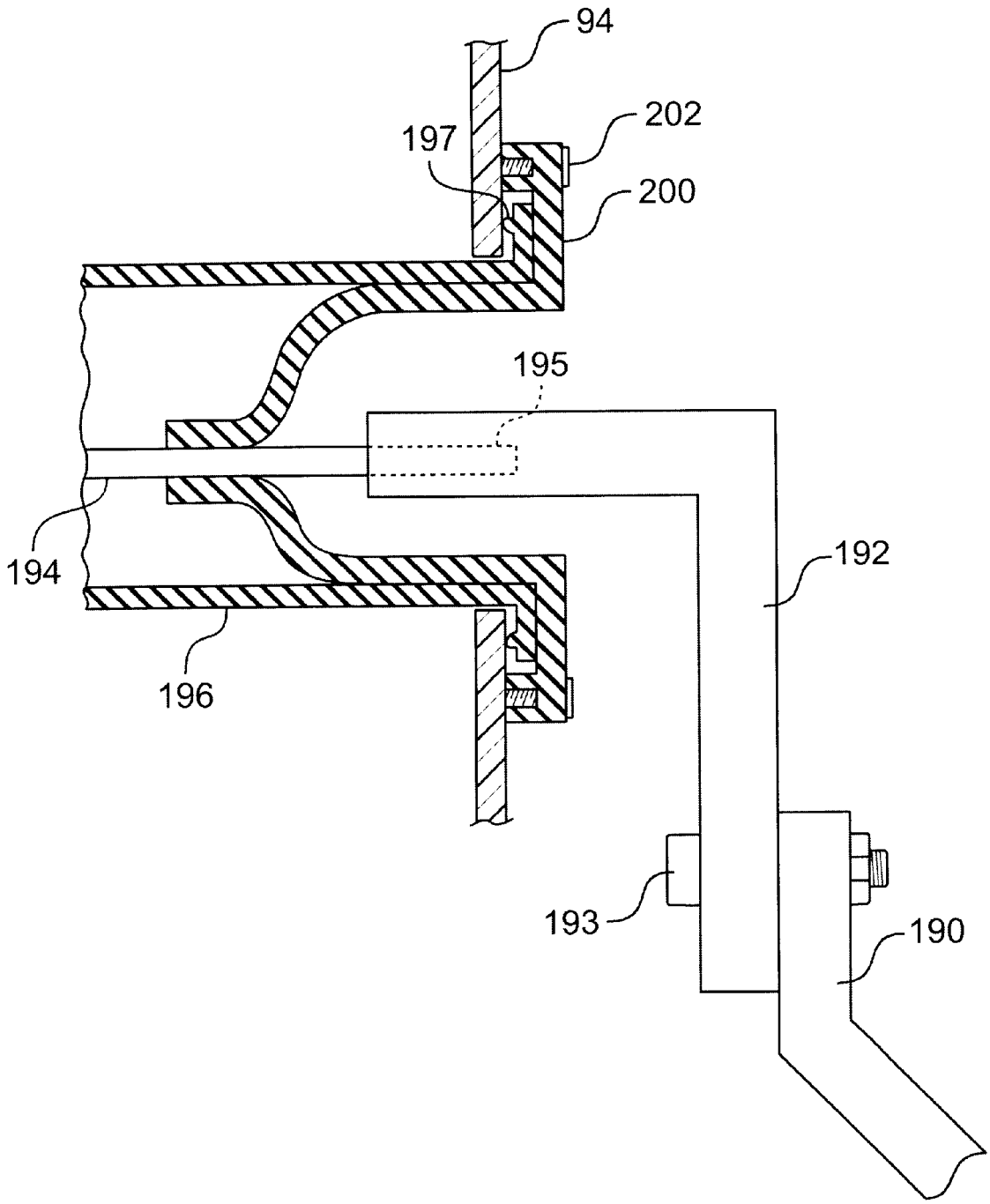
FIG. 13 is an enlarged back view in partial section of a connecting portion between the propulsion system and a vane.

The yoke 190 is attached at each end to a generally L-shaped bracket 192 that extends into the side walls of the tunnel 94 to connect to the rod 194. The brackets 192 are preferably made of a resilient material, such as Delrin®, and are each connected to the yoke 190 at one end with a fastener 193 and have a fitting 195 for receiving the rod 194 at the other end. FIG. 13 shows an enlarged detail of one type of suitable connection between the yoke 190 and the rod 194. The fastener 193 is preferably received in aligned bores in the bracket 192 and the yoke 190 and secured with a nut or some other suitable mechanism to allow pivotal movement between the yoke 190 and the bracket 192. The end of the rod 194 is threaded so that the rod 194 is retained in the fitting 195 in the perpendicular portion of bracket 192 by threaded engagement. A low friction tape, such as conventional masking tape, is wrapped around the threads of the rod 194 so that some rotational play can occur between the rod 194 and the flexible member 192. As the port and starboard sides are the same, only one side is explained in detail.

The rod 194 extends through the hull 12 from the tunnel 94 to the depression 138 through water tight fittings 200 disposed in the hull walls. The rod 194 is preferably made of a corrosion resistant material, such as stainless steel, as it is exposed to the ambient water. The rod could also be referred to as a linking member. A flexible tube 196, for example made of rubber or plastic, surrounds the rod 194 within the hull 12 and also extends from the tunnel wall 94 to the depression wall 138. The tube 196 preferably has an annular bead 197 on the lip that forms its opening end and overlaps the wall of the hull 12. The fittings 200 are attached to the hull wall, by tap screws 202 for example, to clamp the lip of the tube 196 to the hull 12 to create a seal between the bead 197 of the tube 196 and the opening in the hull walls to ensure that water does not enter the interior of the hull. As seen in FIG. 13, the edge of the fitting 200 has a stop formation that is formed as an enlarged lip at the edge that prevents the screws 202 from clamping the fitting 200 too tightly over tube 196, which would over squeeze the edge of flexible rubber tube 196 and impair sealing. Of course, any type of suitable sealing assembly can be used. For example, the end of the bracket 192 could also protrude through the wall of the tunnel 94 to a sealing mount as seen in FIG. 11. Alternatively, sealing material can be over-molded over the end of fitting 200 to sealingly cover screws 202.

The other end of the rod 194 protrudes from the hull 12 in the depression 138 to form a pivot arm 198 that rotatably connects to pivot rod 163. By this arrangement, movement translated to the yoke 190 is transferred through the bracket 192 to the rod 194 and the arm 198 to push or pull the vane 140 away or toward the hull 12 about the pivot axis defined by the piston rod 182. The resilient bracket 192 absorbs forces experienced by the vanes 140 during operation and prevents the transmission of undesirable forces to the nozzle 102. For example, if the vane 104 receives a lateral impact, for example by hitting an obstruction such as rock, the force transmitted through the rod 194 will be absorbed by the bracket 192 and will not cause damage to the nozzle 102 or any other component that forms the linkage between the vane 140 and the nozzle 102.

When the steering handles 74 are not turned (i.e., in a neutral position), the vanes 140 remain in a neutral position in which each vane 140 is disposed at a slight angle to the hull 12 such that the trailing edge 146 is disposed farther from the hull 12 than the leading edge 142. This creates a slight "plow" effect. Then, when an operator of the PWC 10 turns the steering handles 74, the vanes 140 turn in correspondence. When the vanes 140 are pivoted to assist with steering, the vane 140 that is pivoted outwardly is disposed at a greater angle with respect to the hull 12 than the angle at which the vane 140 that is pivoted inwardly is disposed with respect to the hull 12. In other words, the opposed vanes 140 are not parallel when pivoted. This is advantageous in that the vane 140 on the side of the hull 12 in the direction that the watercraft is to be turned assumes a larger role in deflecting water. Simultaneously, the vane 140 on the opposed side of the hull 12 provides additional steering assistance, but does not pivot to an extent that would create an interference with the desired steering motion.

It is also possible to connect the steering handles 74 to the vanes 140 to actuate pivoting of the vanes 140 by by-passing the nozzle 102 by providing a separate mechanical linkage or electrical signaling system. Further, in cases where the nozzle is replaced by a rudder, for example, the steering handles 74 would be connected to the rudder or some other actuating mechanism. Additionally, it is possible to provide a vane actuator separate from the steering handles, in the form of a separate lever or joystick, for example.

It is apparent that in low thrust situations it would be advantageous to pivot the vanes 140 inwardly and outwardly to assist in steering by diverting water with the vanes 140. However, it may be desirable to inactivate the vanes 140 during operation so that turning would not always cause the vanes 140 to pivot into the path of water flowing past the hull 12. For example, in high thrust situations when sufficient thrust is being generated to execute a turn with the water exiting from the jet propulsion system 84, the vanes 140 are not necessary. To accommodate this, the vanes 140 may also be connected to the jet propulsion system 84 so that they are only operative, i.e. disposed in an operative position, when thrust drops below a predetermined level.

Referring to FIGS. 10, 11, and 15A–15C, as described above, each vane 140 is mounted on a hydraulic cylinder 180 on its corresponding bracket 164. The hydraulic cylinder 180, as seen in detail in FIGS. 15A–15C, is mounted on the face plate 168 and includes a water jacket 204 that surrounds the piston rod 182. The piston rod 182 is rotatably attached to bores in the flanges 160 on the top and bottom surfaces of each vane 140. A spring 206 is disposed within the water jacket 204 around the piston rod 182. The spring 206 normally biases the vane 140 in a downward or operative position. In the operative position, the vanes 140 are positioned such that a substantial portion lies below the water line. In the inoperative position, the vanes 140 are suspended above the water line so that the majority of the vane 140 is held out of the water.

The water jacket 204 is in fluid communication with the fluid port 184. A water line 208 is connected to the fluid port 184 and provides a fluid path from the jet propulsion system 84 to the hydraulic cylinder 180. As will be described below, by this arrangement, water pressure, which acts as a signal, is transmitted from the jet propulsion system 84 to the vane 140 to selectively move the vane 140 between the operative and inoperative positions.

In detail, the hydraulic cylinder 180 includes vertically sliding piston rod 182 that has a piston head 210 fixedly mounted on the piston rod 182. The piston head 210 has a pair of diametrically opposed bores, and the rod 182 has a pair of diametrically opposed bores 212. A spring pin 214 is inserted through the bores 212 to fix the piston head 210 on the rod 182. The coil spring 206 is received between the upper end of the water jacket 204 and the piston head 210 to bias the piston head 210 downwardly.

The lower end of the water jacket 204 has a threaded opening that is scaled with a threaded plug 216. A hard plastic wear insert 218 is mounted within the central bore of the plug 216 to reduce wear on the plug 216 by the vertical movement of the piston rod 182. A pair of split sealing rings 220, 222 is mounted within the wear insert 218 to provide a seal against the rod 182. The sealing rings 220, 222 are preferably made of hard plastic to prevent them from wearing down or sticking to the piston rod 182, as may happen if using a soft rubber. Preferably, the wear insert 218 has ribs (not shown) that are offset to engage and index the sealing rings 220, 222. By this, the slots in the sealing rings 220, 222 are offset, by 180° for example, to prevent leakage.

The piston head 210 has an annular groove in which a pair of split sealing rings 224, 226 is received. These sealing rings 224, 226 provide a seal between the water jacket 204 interior surface and the piston head 210. One on side of the groove in the piston head 210 is a projection 228 that extends downwardly into the vertical split of the upper sealing ring 224. This projection 228 keeps the upper sealing ring 224 from rotating. A similar projection (not shown) is provided on the other side of the groove and extends upwardly into the vertical split of the lower sealing ring 226, which keeps the lower ring 226 from rotating. As a result of these projections, the splits in the rings 224, 226 are prevented from becoming aligned, which functions to provide for a better seal. Similar projections can be provided on wear insert 218 to provide an improved seal for rings 220, 222. Alternatively, the projection 228 can be eliminated. In that case, the rings 224, 226 can be provided with integral ribs that interlock with the slot in the adjacent ring. Thus, the slots are held in an offset position and a tight seal can be ensured.

The interior of the water jacket 204 is tapered, being wider at the bottom and narrower at the top, as seen in FIG. 15A. As a result, the seal between the piston head 210 and the water jacket interior surface is relatively tight, which prevents pressure loss. However, as the head 210 travels downwardly, a gap is formed between the piston head 210 and the piston interior surface. This gap enables water underneath the piston head 210 to flow upwardly to the region above the piston head 210, which reduces resistance to the lowering of the piston head 210. This allows for faster movement of the vane 140, which is connected to the piston rod 182, down to its operative position.

The lower end of the water jacket 204 communicates with the pressurized water in the jet propulsion system 84, in this case the venturi 100, via the piston fluid port 184 and water line 208. Thus, when the water is pressurized by the impeller, water flows from the venturi 100, through the water line 208 into the water jacket 204, which forces the piston head 210 upwardly against the spring 206. As discussed in detail below, because the vane 140 is connected to the piston rod 182, the vane 140 is raised upwardly into its inoperative position. Holes (not shown) are provided in the upper end of the water jacket 204 to allow water and/or debris that may have entered the water jacket 204 above the piston head 210 to be expelled during upward movement of the piston head 210.

Referring to FIGS. 15A and 17, the upper end of the piston rod 182 has a bore 230 formed therethrough. The upper end of the piston rod 182 is received in an upper pivot mounting bore 232 of the flange 160 of the vane 140. A threaded rod 235 is inserted into a transverse aperture in the flange 160 and threaded into the bore 230 to lock the upper end of the piston rod 182 relative to the vane 140. The lower end of the piston rod 182 is notched to receive a projection (not shown) in a corresponding bore in the lower flange 160. These two connections ensure that the piston rod 182 and the vane 140 are locked together both rotationally and axially, thus enabling the piston rod 182 and vane 140 to move together both pivotally and vertically.

Referring to FIG. 10, to connect the brackets 164 to the hull 12, each bracket 164 is placed on the surface of the depression 138 with seal 173 therebetween in alignment with bores made in the hull 12 for the rod 194 and the water line 208. First, the rear support 174, in the form of an X-bracket, is placed on the inner surface of the hull 12 with its mounting bores aligned with the hull bores. A bolt is inserted through the X-bracket center bore and a center bore in the hull to initially mount the bracket 164 with the other four hull bores and the other four bracket bores aligned. The bracket 164 (along with the entire unit 180) and the seal 173 are then placed on the exterior surface of the hull with the mounting bores aligned with the four hull bores and the four X-bracket bores. Four bolts 166 are then inserted through these aligned bores to attach the bracket 164 to the hull wall. The piston fluid port 184 extends through the bore below the X-bracket 174 into the interior of the hull 12 for connection to the water line 208. A hull bore spaced to the side of the X-bracket 174 receives the pivot arm 198 of the rod 194.

As seen in FIGS. 10 and 11, the water line 208 extends from each side of the watercraft 10 through the hull 12 from the depressions 138 to a fitting 234 disposed in the top wall of the tunnel 94. Each water line 208 is designed to be the same length between the fitting 234 and the fluid port 184 for each vane 140. By this, the vertical displacement of each vane 140 is synchronized. The fitting 234 provides a fluid connection from the jet propulsion system 84 disposed within the tunnel 94 to the water line 208. One type of suitable fitting 234 is shown in detail in FIG. 12. Preferably, the fitting 234 connects to the venturi 100 of the jet propulsion system 84, but it is possible to connect the fitting 234 to other portions of the jet propulsion system 84 as well.

Figure 12:
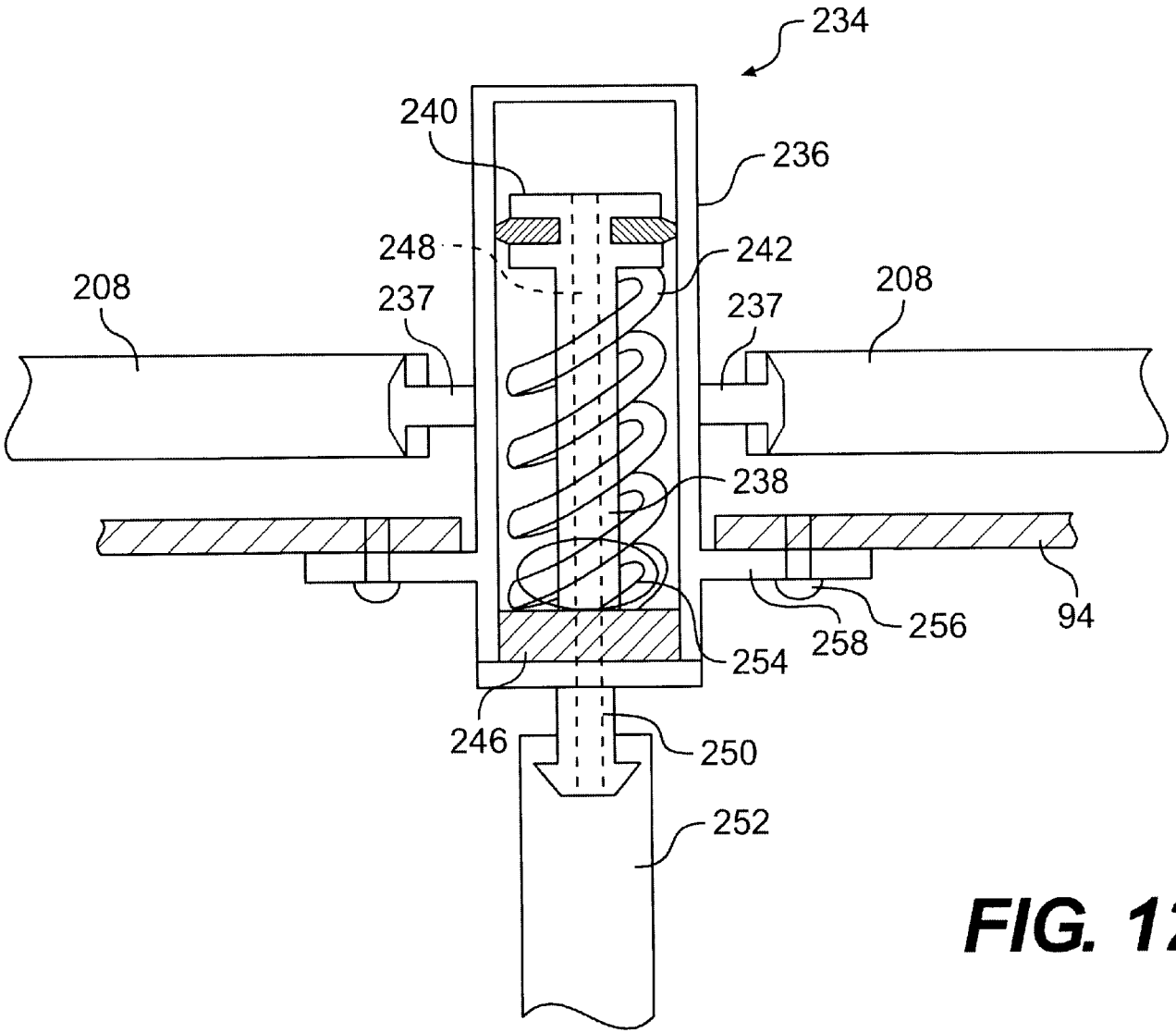
FIG. 12 is an enlarged schematic view of a valve that may be used in the operating system of the side vanes.

The fitting 234 of FIG. 12 is a T-type connector that is designed to function as a valve to let water flowing back from the hydraulic cylinder 180 into the tunnel 94 without creating a back up of pressure. The fitting 234 includes a cylinder 236 with a pair of connection members 237 extending from each side. A tubular piston rod 238 with an integral piston head 240 is slidably mounted in the cylinder 236. A spring 242 biases the piston head upwardly, and a plug 246 closes the bottom opening of the cylinder 236. The piston rod 238 has a fluid passageway 248 therethrough.

The lower end of the piston rod 238 is a connector 250 that attaches to a flexible hose 252, which in turn is connected to the venturi 100 to enable a stream of pressurized water from the venturi 100 to flow upwardly through passageway 248 into the upper region of the cylinder 236. This forces the piston rod 238 and head 240 downwardly past connection members 237 so that pressurized water from the venturi 100 flows into the connection members 237. The water is then communicated by water lines 208 to their respective hydraulic cylinders 180 to maintain the respective vanes 140 in their inoperative or raised positions. The hose 252 flexes to accommodate this downward movement. Preferably, a filter is disposed in the fitting between the hose 252 and the jet propulsion system 84, shown generally at 253, to prevent debris from entering the hydraulic system associated with the vanes 140.

As the water pressure in the venturi 100 drops, the spring 242 forces the piston head 240 and rod 238 upwardly. As the piston head 240 passes the connection members 237, the water in the lines 208 can flow back into the piston region underneath the piston head 240 and out through a port 254 formed in the cylinder 236. This allows the springs 206 in the hydraulic cylinders 180 to automatically push their respective vanes 140 down into their operative positions. The fitting 234 is preferably fastened to the underside of the tunnel wall 94 by bolts 256 inserted through flanges 258 extending from the cylinder 236.

Of course, any suitable fitting between the water line 208 and the jet propulsion system 84 could be used, especially a fitting without a valve. For example, the fitting 234 could be implemented as a T-fitting without the relief pressure effect or could be a check valve. Use of a check valve will slow the lowering of the vanes 140, while use of a relief valve will speed lowering of the vanes 140. Thus, the fitting can be designed according to desired operating parameters. A closed hydraulic system could also be implemented that is merely pressure actuated.

Additionally, it would be possible to provide a pressure responsive system without a direct fluid path from the jet propulsion system 84 to the vane 140. For example, an electronically actuated pressure responsive arrangement, or even a pneumatic or purely mechanical arrangement, could be provided to generate a signal to actuate the vanes 140 in response to a drop in thrust. One way to separately actuate the vanes would be to use a throttle sensor to sense a throttle position or electronic fuel injection setting that would correspond to a predetermined thrust threshold to control the position of the vanes 140. Additionally, an engine RPM (revolutions per minute) sensor could be used.

Figure 16:
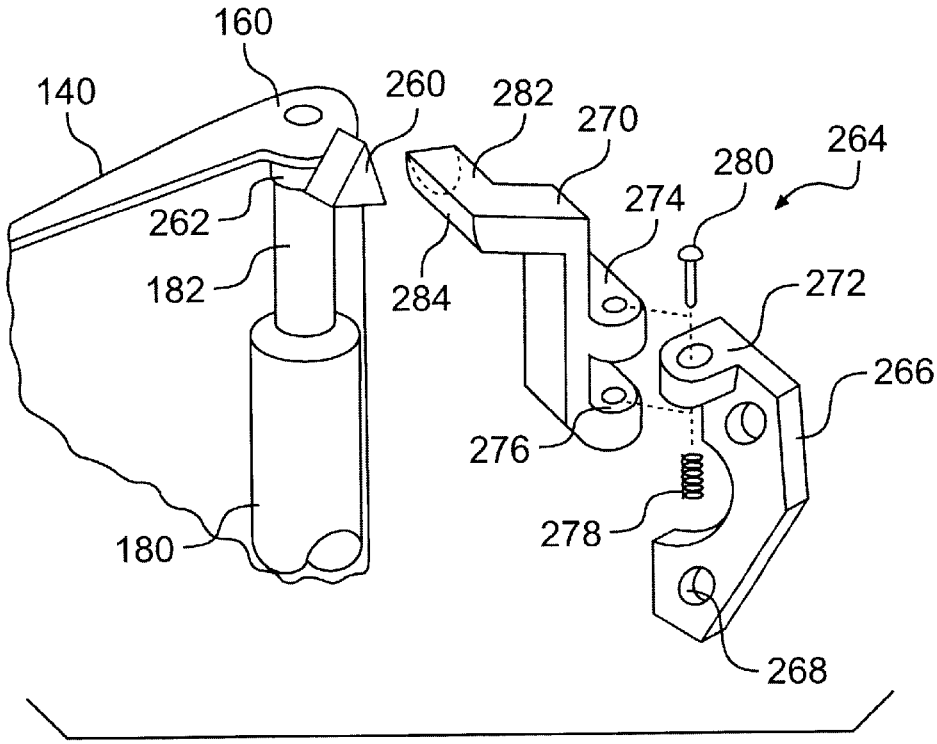
FIG. 16 is an exploded partial isometric view of an embodiment of a limiting mechanism associated with the vane.

If it is desired to maintain the vanes 140 in a raised, inoperative position regardless of the pressure in the jet propulsion system, a self blocking device may be incorporated in the design. In this case, only turning the steering handles 74 (or otherwise communicating a steering signal) will activate the vanes 140. Referring to FIG. 16, a protrusion 260 is provided adjacent the vane 140. The protrusion 260 is formed as a triangular extension that may be connected to the top of piston rod 182 by a sleeve 262 that slides over the top of the shaft or that is received in the bore of the flange 160. A control bracket 264 formed in two pieces is fastened to a support such as the hull 12 or the vane mounting bracket 164.

The first piece of the control bracket 264 is a mounting element 266 that has apertures 268 for receiving mounting fasteners. The second piece is a stop element 270 that is supported by mounting element 266 in a biased pivoting relationship. Mounting element 266 has an ear 272 with a bore that fits between a pair of ears 274, 276 with a spring 278 and a pin 280. By this, the stop element 270 is biased in a predetermined position with respect to the mounting element 266, but may pivot upon an application of force. The stop element 270 has an arm 282 that extends outwardly and has a semi-circular bottom surface 284. When the vane 140 is mounted on the hull 12, the control bracket 264 is positioned adjacent to the vane 140 so that the protrusion 260 and the arm 282 can interact.

Figure 16A:
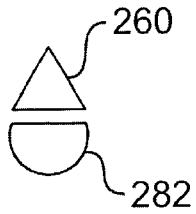
FIGS. 16A through 16D are schematic representations of the interaction of the components of the limiting mechanism of FIG. 16.
Figure 16B:
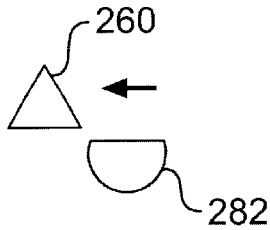
Figure 16C:
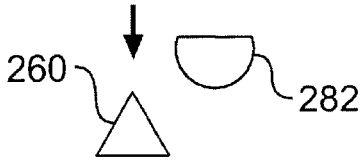
Figure 16D:
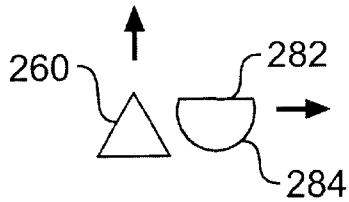

As seen schematically in FIGS. 16A–16D, the control element 264 interacts with the protrusion 260 to prevent the vane 140 from lowering unless it is pivoted, as during a steering command. FIG. 16A shows an aligned locked or stopped position in which the arm 282 is positioned beneath the protrusion 260 and prevents the protrusion 260 from lowering. Thus, the vane 140 is held in the raised inoperative position. FIG. 16B illustrates when the vane 140 is pivoted due to a steering command. In this case, the protrusion 260 moves out of alignment with the arm 282. In FIG. 16C, the protrusion 260 can move down past the arm 282 and the vane 140 is lowered into the operative position. This action will occur when thrust decreases as evidenced by low pressure in the jet propulsion system 84. In FIG. 16D, the vane 140 is raised into the inoperative position due to an increase in pressure in the jet propulsion system 84 and the protrusion 260 lifts upwardly. Because the protrusion 260 has an inclined edge, the protrusion 260 pushes the curved edge 284 of the arm 282, against the spring bias, out of the way. When the vane 140 is completely raised and the protrusion 260 clears the edge 284, the stop element 270 will pivot back into a locked position with the arm 282 beneath the protrusion 260. By this arrangement, lowering of the vanes 140 due to a drop in pressure can be prevented unless the steering handles 74 are also turned.

FIG. 17 shows another embodiment of a stopping mechanism. In this embodiment, the piston rod 182 has a groove 286 cut into one side. A spring loaded blocker 288 is retained by the bracket 164 to interact with the groove 286. The blocker 288 is a U-shaped resilient element, preferably made of metal, which has ends retained in the face plate 168 of the bracket 164 that extend through bores in the upper flange 170. As noted above, the piston rod 182 is retained in the flange 160 of the vane 140 in a fixed relationship due to the rod 235. Thus, when the vane 140 is turned due to a steering command, the piston rod 182 turns. This causes the groove 286 to move out of alignment with the blocker 288 and allows the piston rod 182 to move in response to pressure in the hydraulic cylinder 180. The vane 140 can then be lowered. When the vane 140 is raised and turned to a neutral position, the blocker 288 then snaps back into the groove 286. This acts to retain the vane 140 in a raised inoperative position unless the vane 140 is pivoted.

Either blocking or stopping mechanism could also be implemented in a permanent manner, which would not be actuated by the steering assembly. Other types of permanent blocking mechanisms could be employed to deactivate the assembly.

Although the above description contains specific examples of the present invention, these should not be construed as limiting the scope of the invention but as merely providing illustrations of some of the presently preferred embodiments of this invention. Thus, the scope of the invention should be determined by the appended claims and their legal equivalents rather than by the examples given.

Additionally, as noted previously, this invention is not limited to PWC. For example, the vane assisted steering systems disclosed herein may also be useful in small boats or other floatation devices other than those defined as personal watercrafts.

Further, the propulsion unit of such craft need not be a jet propulsion system but could be a regular propeller system. In such a case, the water lines between the nozzle and the vanes could be replaced with lines that provide actuating control to the vanes without using pressurized water. For example, the lines could provide an electrical signal to electrically operate pistons or solenoids.

Also, the vanes need not have any connection to the helm or the nozzle. Instead, the vanes could be operated by an actuator separate from the helm. For example, a small joystick could be used to deploy the vanes and determine the direction of steering.

What is claimed is:

1. A personal watercraft comprising:

a hull having port and starboard sides and a stern;

a deck mounted on the hull;

a straddle seat for an operator supported by the deck;

a helm supported by the deck forward of the straddle seat including a steering handle and a throttle controller;

a jet propulsion unit supported by the hull, including an inlet for taking in water, an impeller assembly for generating a pressurized stream of water, an outlet for discharging the pressurized stream of water, and a movable element positioned at the outlet for selectively directing the pressurized stream of water, wherein the movable element is operatively connected to the steering handle and directs the pressurized stream of water based on signals from the steering handle;

a pair of vanes, each vane being mounted on one of the port side and the starboard side of the hull, wherein each vane is spaced a predetermined distance from the hull; and a steering actuator associated with each vane and operatively connected to the steering handle so that steering signals are transmitted from the steering handle to the vanes.

2. The personal watercraft of claim 1, wherein the movable element is a nozzle.

3. The personal watercraft of claim 2, wherein the steering actuator includes a rod that extends through the hull and is connected at one end to the nozzle and at the other end to the vane, so that pivoting the nozzle pushes or pulls the rod and pivots the associated vane.

4. The personal watercraft of claim 1, wherein the hull includes a depression on the port and starboards side adjacent the stern, wherein each vane is received in one of the depressions in the hull.

5. The personal watercraft of claim 1, further comprising a signal actuator connected to each vane and operatively connected to the jet propulsion unit to selectively raise the vane with respect to the hull when the jet propulsion unit generates thrust above a predetermined threshold.

6. The personal watercraft of claim 5, wherein the signal actuator is a pressure actuator that is responsive to pressure signals transmitted from the jet propulsion unit.

7. The personal watercraft of claim 6, wherein the pressure actuator includes a hydraulic cylinder mounted on each vane and a water line extending from the jet propulsion unit to each hydraulic cylinder.

8. The personal watercraft of claim 1, wherein the vanes are mounted on the hull so that turning the steering handles causes both vanes to pivot with respect to the hull.

9. The personal watercraft of claim 1, wherein the vanes are mounted on the hull so that turning the steering handles a predetermined amount causes both vanes to respond to pressure signals based on thrust generated by the jet propulsion unit.

10. The personal watercraft of claim 1, wherein the vanes are mounted near the stern.

11. The personal watercraft of claim 1, wherein the steering handle has a neutral position in which the steering handle is not turned to either side, and the vanes have a corresponding neutral position in which each of the vanes is disposed at an angle to the hull so that a downstream trailing edge of the vane is tilted away from the hull.

12. The personal watercraft of claim 1, wherein each vane is a generally plate like member with an outer convex surface.

13. The personal watercraft of claim 1, wherein each vane includes a plurality of openings extending therethrough.

14. The personal watercraft of claim 1, wherein each vane has a plurality of fins extending across a surface thereof.

15. A watercraft comprising:

a hull with an operator's area;

a jet propulsion system supported by the hull;

a helm located in the operator's area and including a steering controller;

a pair of vanes supported by the hull for movement with respect to the hull;

a first actuator coupled between the steering controller and each of the vanes to transmit steering signals to at least one of the vanes to pivot the at least one vane with respect to the hull; and a second actuator coupled between the jet propulsion system and each of the vanes to move at least one vane between an operative position and an inoperative position.

16. The watercraft of claim 15, wherein the hull has a stern and the vanes are positioned adjacent to the stern.

17. The watercraft of claim 15, wherein the watercraft is a personal watercraft.

18. The watercraft of claim 15, wherein the hull has a starboard side and a port side, and one of the pair of vanes is attached to the starboard side and the other of the pair of vanes is attached to the port side.

19. The watercraft of claim 18, wherein the hull has a recess on the starboard side and a recess on the port side, and each of the vanes is positioned within a corresponding recess.

20. The watercraft of claim 15, wherein the hull has a straddle type seat for an operator.

21. The watercraft of claim 15, wherein the watercraft is a sport boat.

22. The watercraft of claim 15, wherein the watercraft is a stand-up type personal watercraft with a standing platform for the operator.

23. The watercraft of claim 15, wherein the hull has a tunnel and the jet propulsion system comprises a jet pump disposed within the tunnel with an intake and outlet that expels a pressurized stream of water that propels the watercraft.

24. The watercraft of claim 23, wherein the jet propulsion system includes a steering element connected at the outlet and operatively connected to the steering controller, wherein the steering element pivots in response to steering signals.

25. The watercraft of claim 24, wherein the steering element is a nozzle.

26. The watercraft of claim 15, wherein the steering controller comprises a handlebar.

27. The watercraft of claim 15, wherein the steering controller comprises a joystick.

28. The watercraft of claim 15, wherein the vanes are mounted to the hull with a bracket so that the vanes are spaced from the hull.

29. The watercraft of claim 28, wherein the bracket includes a pivot member that allows the vane to pivot about an axis generally parallel to the hull that is adjacent to the vane between a position generally parallel to the hull and a position at an acute angle to the hull.

30. The watercraft of claim 29, wherein the pivot axis is generally vertical.

31. The watercraft of claim 15, wherein each of the vanes is formed of a concave plate.

32. The watercraft of claim 15, wherein each of the vanes has a plurality of through holes.

33. The watercraft of claim 32, wherein each of the vanes has a plurality of grooves formed in an outer surface of the vane that are in alignment with each of the through holes.

34. The watercraft of claim 33, wherein each of the grooves is angled upwardly from its corresponding through hole and the grooves create a series of aligned fins therebetween.

35. The watercraft of claim 15, wherein each of the vanes has a plurality of fins.

36. The watercraft of claim 15, wherein the jet propulsion system includes a steerable nozzle, and the first actuator comprises a pair of rods, each coupled to the nozzle and one of the vanes, so that steering the nozzle causes each of the rods to move the vanes with respect to the hull.

37. The watercraft of claim 36, wherein the first actuator further comprises a resilient bracket connected between each of the rods and the nozzle.

38. The watercraft of claim 36, wherein each of the rods extends through the hull.

39. The watercraft of claim 36, wherein each of the vanes includes a pivot rod that is coupled to the each of the rods so that movement of the rods causes the vanes to pivot with respect to the hull.

40. The watercraft of claim 36, wherein the hull includes a tunnel that houses the jet propulsion system, and wherein a sleeve extends from each side of the hull to the tunnel and the rod is disposed within the sleeve.

41. The watercraft of claim 36, wherein the second actuator comprises a hydraulic assembly that is responsive to pressure in the jet propulsion system.

42. The watercraft of claim 15, wherein the second actuator comprises a hydraulic assembly that is responsive to pressure in the jet propulsion system.

43. The watercraft of claim 42, wherein the hydraulic assembly comprises a hydraulic cylinder connected to each vane and in communication with the jet propulsion system to raise and lower each of the vanes in response to pressure in the jet propulsion system.

44. The watercraft of claim 43, wherein the second actuator further comprises a fluid conduit extending between the jet propulsion system and each of the hydraulic cylinders to transmit fluid pressure from the jet propulsion system to the hydraulic cylinders to raise the vanes into the inoperative position when the pressure in the jet propulsion system exceeds a threshold.

45. The watercraft of claim 43, wherein each of the hydraulic cylinders includes a biasing mechanism that urges the vanes into the operative position.

46. The watercraft of claim 42, further comprising a valve associated with the hydraulic assembly to allow fluid to drain from the assembly when the pressure in the jet propulsion system falls below a threshold.

47. The watercraft of claim 42, further comprising a blocking device associated with the hydraulic assembly that blocks the vane from moving in response to pressure in the jet propulsion system unless the first actuator transmits a steering signal to at least one of the vanes.

48. The watercraft of claim 47, wherein the blocking device comprises a spring biased stop element supported at a fixed position with respect to the hull and the hydraulic assembly includes a piston rod having stop groove, wherein the spring biased stop element selectively engages the stop groove.

49. The watercraft of claim 47, wherein the blocking device comprises a spring biased stop element supported at a fixed position with respect to the hull and the vane includes a protrusion extending toward the spring biased stop element, wherein the spring biased stop element selectively engages the protrusion.

50. The watercraft of claim 15, further comprising a blocking device associated with the second actuator that blocks the vane from moving in response to pressure in the jet propulsion system unless the first actuator transmits a steering signal to at least one of the vanes.

51. The watercraft of claim 50, wherein the blocking device comprises a spring biased stop element supported at a fixed position with respect to the hull and the second actuator includes a piston rod having stop groove, wherein the spring biased stop element selectively engages the stop groove.

52. The watercraft of claim 50, wherein the blocking device comprises a spring biased stop element supported at a fixed position with respect to the hull and the vane includes a protrusion extending toward the spring biased stop element, wherein the spring biased stop element selectively engages the protrusion.

53. The watercraft of claim 15, wherein the second actuator comprises a hydraulic system that raises and lowers the vanes with respect to the hull in response to pressure signals.

54. The watercraft of claim 15, wherein the first actuator transmits steering signals from the steering controller to pivot the vanes inwardly and outwardly with respect to sides of the hull based on manually turning the steering controller, and wherein the second actuator automatically raises and lowers the vanes based on pressure in the jet propulsion system.

55. The watercraft of claim 15, wherein the first actuator pivots both of the pair of vanes in tandem.

56. The watercraft of claim 15, further comprising sponsons supported on each side of the hull.

57. The watercraft of claim 15, further comprising trim tabs supported by the hull and controlled by a trim controller at the helm.

58. The watercraft of claim 15, wherein the jet propulsion system comprises a pair of jet pumps, each having a nozzle, and each of the vanes is operatively connected to one of the jet pumps and nozzles.

59. A personal watercraft comprising:

a hull having a pair of side walls and a bottom with a tunnel;

a helm supported by the hull and having a steering member;

a jet propulsion unit supported by the hull in the tunnel and having an inlet that draws in water and an outlet that expels a pressurized stream of water that propels the personal watercraft, wherein a steering element is attached to the outlet and directs the pressurized stream of water in response to the steering member to steer the personal watercraft in a desired direction; and a pair of side vanes, each vane being supported by a side wall of the hull, wherein each vane is operatively connected to the steering member to pivot with respect to the associated side of wall in response to movement of the steering member, and wherein each vane is operatively connected to the jet propulsion unit to raise and lower with respect to the side wall in response to pressure in the jet propulsion unit.

60. The personal watercraft of claim 59, wherein the hull has a stern, and the pair of side vanes are attached to the hull near the stern.

61. The personal watercraft of claim 59, wherein the side vanes are attached to the side walls by a bracket that spaces the side vanes from the side walls.

62. The personal watercraft of claim 59, wherein the steering element is a nozzle.

63. The personal watercraft of claim 62, further comprising a movable rod coupled between the nozzle and each of the side vanes to pivot the side vanes with respect to the sides of the hull when the nozzle is pivoted.

64. The personal watercraft of claim 59, further comprising a hydraulic cylinder coupled to each vane and connected to the jet propulsion unit so that pressure above a threshold from the jet propulsion unit is transmitted to the hydraulic cylinder to lift the associated vane.

65. The personal watercraft of claim 64, wherein each hydraulic cylinder includes a movable piston attached to each vane that is generally parallel to the side wall of the hull and a spring connected to the hydraulic cylinder that urges the piston to move the vane downward with respect to the side wall of the hull.

66. The personal watercraft of claim 65, further comprising a blocking device positioned between each of the vanes and the hull that blocks lowering of the vanes in response to pressure in the jet propulsion unit unless the vanes are pivoted in response to movement of the steering member.

67. The personal watercraft of claim 59, further comprising a blocking device positioned between each of the vanes and the hull that blocks lowering of the vanes in response to pressure in the jet propulsion unit unless the vanes are pivoted in response to movement of the steering member.

68. The personal watercraft of claim 59, further comprising a deck mounted on the hull, wherein the deck supports a straddle seat for an operator.

* * * * *